US008212763B2

(12) United States Patent
Yokota et al.

(10) Patent No.: US 8,212,763 B2
(45) **Date of Patent: *Jul. 3, 2012**

(54) LIQUID CRYSTAL DISPLAY CONTROLLER AND LIQUID CRYSTAL DISPLAY DEVICE

(75) Inventors: Yoshikazu Yokota, Kodaira (JP); Kunihiko Tani, Kodaira (JP); Gorou Sakamaki, Kodaira (JP); Katsuhiko Yamamoto, Tachikawa (JP); Takashi Yoneoka, Tachikawa (JP); Kazuhisa Higuchi, Tachikawa (JP); Kimihiko Sugiyama, Matsudo (JP)

(73) Assignee: Renesas Electronics Corporation, Kanagawa (JP)

( * ) Notice: Subject to any disclaimer, the term of this patent is extended or adjusted under 35 U.S.C. 154(b) by 315 days.

This patent is subject to a terminal disclaimer.

(21) Appl. No.: 12/709,929

(22) Filed: Feb. 22, 2010

(65) Prior Publication Data

US 2010/0156876 A1 Jun. 24, 2010

Related U.S. Application Data

(63) Continuation of application No. 11/594,190, filed on Nov. 8, 2006, now Pat. No. 7,688,303, which is a continuation of application No. 10/778,165, filed on Feb. 17, 2004, now Pat. No. 7,286,110, which is a continuation of application No. 10/279,987, filed on Oct. 25, 2002, now Pat. No. 6,747,628, which is a continuation of application No. 09/621,618, filed on Jul. 21, 2000, now Pat. No. 6,633,274, which is a continuation of application No. 09/015,332, filed on Jan. 29, 1998, now Pat. No. 6,181,313.

(30) Foreign Application Priority Data

Jan. 30, 1997 (JP) ..... 9-16935

(51) Int. Cl.
*G09G 3/36* (2006.01)

(52) U.S. Cl. ..... 345/100; 345/51; 345/90; 345/98; 345/204; 345/211; 345/214

(58) Field of Classification Search ..... 345/51, 345/90, 98–100, 204, 211, 212, 214
See application file for complete search history.

(56) References Cited

U.S. PATENT DOCUMENTS 4,687,956 A 8/1987 Itoh (Continued)

FOREIGN PATENT DOCUMENTS

JP 01-198793 8/1989

(Continued)

*Primary Examiner* — Lun-Yi Lao
*Assistant Examiner* — Sosina Abebe
(74) *Attorney, Agent, or Firm* — Mattingly & Malur, PC

(57) ABSTRACT

In conventional liquid crystal display controllers such as for portable telephone sets, the display is reduced in the stand-by state but the liquid crystal display duty is not changed, i.e., even the common electrodes of the rows that are not producing display are scanned, and the consumption of electric power is not decreased to a sufficient degree in the stand-by state. A liquid crystal display controller (2) includes a drive duty selection register (34) capable of being rewritten by a microprocessor (1), and a drive bias selection register (32). When the display is changed from the whole display on a liquid crystal display panel (3) to a partial display on part of the rows only, the preset values of the drive duty selection register and of the drive bias selection register are changed, so that the display is selectively produced on a portion of the liquid crystal display panel at a low voltage with a low-duty drive.

6 Claims, 35 Drawing Sheets

U.S. PATENT DOCUMENTS

| | | | | | |
|---|---|---|---|---|---|
| 4,958,151 | A | * | 9/1990 | Ushiki et al. | 345/211 |
| 4,981,339 | A | | 1/1991 | Nishimura | |
| 5,192,942 | A | | 3/1993 | Yamada | |
| 5,223,824 | A | | 6/1993 | Takeda | |
| 5,463,408 | A | | 10/1995 | Mio | |
| 5,663,743 | A | | 9/1997 | Fuji | |
| 5,670,973 | A | | 9/1997 | Bassetti, Jr. | |
| 5,724,057 | A | | 3/1998 | Kimura | |
| 5,745,092 | A | * | 4/1998 | Ito | 345/95 |
| 5,805,121 | A | | 9/1998 | Burgan | |
| 5,841,431 | A | | 11/1998 | Simmers | |
| 5,859,625 | A | | 1/1999 | Hartung | |
| 5,867,140 | A | * | 2/1999 | Rader | 345/98 |
| 5,877,733 | A | | 3/1999 | Uchida | |
| 5,949,398 | A | | 9/1999 | Kim | |
| 6,160,594 | A | | 12/2000 | Hanami | |
| 6,181,313 | B1 | | 1/2001 | Yokota et al. | |
| 6,624,801 | B2 | | 9/2003 | Moriyama | |

FOREIGN PATENT DOCUMENTS

| | | |
|---|---|---|
| JP | 2-131786 | 11/1990 |
| JP | 3-119385 | 5/1991 |
| JP | 06-095621 | 4/1994 |
| JP | 06-149184 | 5/1994 |
| JP | 07-281632 | 10/1995 |
| JP | 08-202318 | 8/1996 |
| JP | 08-304774 | 11/1996 |
| JP | 09-005775 | 1/1997 |

* cited by examiner

1/32 DUTY DRIVE (DUTY RATIO)

1/16 DUTY DRIVE (COM1~COM16)

1/8 DUTY DRIVE (COM1~COM8)

1/8 DUTY DRIVE (COM1~COM8)

1/16 DUTY DRIVE (COM9~COM24)

1/8 DUTY DRIVE (COM9~COM16)

1/16 DUTY DRIVE (COM9~COM24)

1/8 DUTY DRIVE (COM9~COM16)

CHARGE PERIOD

1 POWER BOOSTED VOLTAGE OUTPUT (=Vci)

2 POWER BOOSTED VOLTAGE OUTPUT (=2×Vci)

3 POWER BOOSTED VOLTAGE OUTPUT (=3×Vci)

1/6.5 BIAS
(BS2-0= "000")

1/6 BIAS
(BS2-0= "001")

1/5.5 BIAS
(BS2-0= "010")

1/5 BIAS
(BS2-0= "011")

1/4.5 BIAS
(BS2-0="100")

1/4 BIAS
(BS2-0="101")

1/3 BIAS
(BS2-0="110")

1/2 BIAS
(BS2-0="111")

FIG. 14(J)

| CT SETTING VALUE | | | | | THE VALUE OF VARIABLE REGISTANCE (VR) |
|---|---|---|---|---|---|
| CT4 | CT3 | CT2 | CT1 | CT0 | |
| 0 | 0 | 0 | 0 | 0 | 3.2×R |
| 0 | 0 | 0 | 0 | 1 | 3.1×R |
| 0 | 0 | 0 | 1 | 0 | 3.0×R |
| 0 | 0 | 0 | 1 | 1 | 2.9×R |
| 0 | 0 | 1 | 0 | 0 | 2.8×R |
| 0 | 0 | 1 | 0 | 1 | 2.7×R |
| 0 | 0 | 1 | 1 | 0 | 2.6×R |
| 0 | 0 | 1 | 1 | 1 | 2.5×R |
| 0 | 1 | 0 | 0 | 0 | 2.4×R |
| 0 | 1 | 0 | 0 | 1 | 2.3×R |
| 0 | 1 | 0 | 1 | 0 | 2.2×R |
| 0 | 1 | 0 | 1 | 1 | 2.1×R |
| 0 | 1 | 1 | 0 | 0 | 2.0×R |
| 0 | 1 | 1 | 0 | 1 | 1.9×R |
| 0 | 1 | 1 | 1 | 0 | 1.8×R |
| 0 | 1 | 1 | 1 | 1 | 1.7×R |
| 1 | 0 | 0 | 0 | 0 | 1.6×R |
| 1 | 0 | 0 | 0 | 1 | 1.5×R |
| 1 | 0 | 0 | 1 | 0 | 1.4×R |
| 1 | 0 | 0 | 1 | 1 | 1.3×R |
| 1 | 0 | 1 | 0 | 0 | 1.2×R |
| 1 | 0 | 1 | 0 | 1 | 1.1×R |
| 1 | 0 | 1 | 1 | 0 | 1.0×R |
| 1 | 0 | 1 | 1 | 1 | 0.9×R |
| 1 | 1 | 0 | 0 | 0 | 0.8×R |
| 1 | 1 | 0 | 0 | 1 | 0.7×R |
| 1 | 1 | 0 | 1 | 0 | 0.6×R |
| 1 | 1 | 0 | 1 | 1 | 0.5×R |
| 1 | 1 | 1 | 0 | 0 | 0.4×R |
| 1 | 1 | 1 | 0 | 1 | 0.3×R |
| 1 | 1 | 1 | 1 | 0 | 0.2×R |
| 1 | 1 | 1 | 1 | 1 | 0.1×R |

FIG. 23

| NL2 | NL1 | NL0 | DISPLAY LINE NUMBERS | DRIVE DUTY | COMMON DRIVER TO USE |
|---|---|---|---|---|---|
| 0 | 0 | 0 | SEGMENT DISPLAY ONLY | 1/2 DUTY | COMS1, COMS2, |
| 0 | 0 | 1 | CHARACTER 1 LINE +SEGMENT DISPLAY | 1/10 DUTY | COM1-8, COMS1, COMS2 |
| 0 | 1 | 0 | CHARACTER 2 LINE +SEGMENT DISPLAY | 1/18 DUTY | COM1-16, COMS1, COMS2 |
| 0 | 1 | 1 | CHARACTER 3 LINE +SEGMENT DISPLAY | 1/26 DUTY | COM1-24, COMS1, COMS2 |
| 1 | * | * | SETTING IS INHIBITED | | |

LIQUID CRYSTAL DISPLAY CONTROLLER AND LIQUID CRYSTAL DISPLAY DEVICE

This is a continuation application of U.S. Ser. No. 11/594,190, filed Nov. 8, 2006, now allowed, which is a continuation application of U.S. Ser. No. 10/778,165, filed Feb. 17, 2004, now U.S. Pat. No. 7,286,110, which is a continuation application of U.S. Ser. No. 10/279,987, filed Oct. 25, 2002, now U.S. Pat. No. 6,747,628, which is a continuation application of U.S. Ser. No. 09/621,618, filed Jul. 21, 2000, now U.S. Pat. No. 6,633,274, which is a continuation application of U.S. Ser. No. 09/015,332, filed on Jan. 29, 1998, now U.S. Pat. No. 6,181,313, the contents of which are hereby incorporated by reference into this application.

BACKGROUND OF THE INVENTION

The present invention relates to technology for controlling display and, specifically, to technology that can be particularly effectively adapted to controlling the drive of liquid crystal, such as technology that can be effectively utilized in a display control circuit in a dot-matrix liquid crystal panel for displaying characters or in a liquid crystal panel having a function of displaying pictures, marks, icons, characters (figures), etc. independently of the dot-matrix character display.

A liquid crystal display device, in general, comprises a liquid crystal display panel, a liquid crystal display controller formed as an integrated circuit on a semiconductor substrate for driving the liquid crystal display panel, and a microprocessor (MPU) or a microcontroller including a microprocessing unit (CPU) for controlling the writing of display data or the display operation of the liquid crystal display controller.

A liquid crystal display controller including a character generator for forming a display pattern of dot-matrix type is constituted by a display data memory for storing character codes (hereinafter referred to as a random access memory for display data or a display data RAM), a character generator memory for storing character patterns such as character fonts (hereinafter referred to as a read-only memory for a character generator or a character generator ROM), an address counter for reading display data from the display data RAM in accordance with the drive position of the liquid crystal display panel, a liquid crystal drive circuit for driving the liquid crystal by generating drive signals for common electrodes and for segment electrodes of a liquid crystal display panel, and a timing generation circuit for generating clock signals that give display timings.

The microprocessor writes, onto the display data RAM, character codes corresponding to characters to be displayed on the liquid crystal display panel. An address counter successively reads out character codes from the display data RAM in accordance with the drive position of the liquid crystal display panel, and successively reads out character patterns by making access to the character generator ROM by using character codes that are read out as part of the addresses. The character patterns that are read out are successively sent, as liquid crystal turn-on/off data, to a segment shift register in the liquid crystal drive circuit. When the data of one line are accumulated, the whole segment driver circuits output the drive voltages of the turn-on/turn-off level simultaneously thereby to drive the liquid crystal display panel.

Each character is constituted by a plurality of lines in a vertical direction and, hence, the above-mentioned control operation is repeated by the number of lines of the character for every display row (8 lines when the character comprises 5 (horizontal)×8 (vertical) dots). The turn-on/turn-off control operation for the display is executed in a time-division manner for each of the lines. Therefore, a selection signal of one line generated from the timing control circuit is sent to a common shift register. As the shift register shifts for each line, a common driver successively outputs a drive voltage of the selection level of the line.

SUMMARY OF THE INVENTION

In a portable telephone set or a portable electronic device such as a pager mounted with the above-mentioned liquid crystal display device, there is no need to produce a display on the whole surface of the liquid crystal display panel during the wait time; i.e., only a minimum of display may be made, such as the display of a calendar, the display of time, a mark called a pictogram or icons. In the liquid crystal display device in a portable telephone set or the like, however, the amount of display is decreased during the wait time but the liquid crystal drive duty is not changed. That is, even the common electrodes of lines that are not displayed are scanned, too, involving a problem that the consumption of electric power cannot be reduced to a sufficient degree during the wait time.

In a liquid crystal display controller having 32 common drivers for, for example, 32 lines are successively and selectively driven, by successively selecting from a common driver corresponding to a signal COM1 to a common driver corresponding to a signal COM32. A method of successively driving such common signal lines of 32 lines is called 1/32 duty drive. In this case, if the character font has a size of 5×8 dots, character strings of 4 rows can be displayed on the liquid crystal panel in the vertical direction. When this liquid crystal display controller is driven for 4 rows in a time-division manner even though 4 rows need not be displayed on the whole surface, the voltage for driving the liquid crystal and the current consumed by the liquid crystal display controller become the same as those of when 4 rows are displayed on the whole surface.

Here, if 4 rows are not displayed on the whole surface during the stand-by state of the system, but if part of the rows is selectively driven, the duty for driving the liquid crystal is lowered, the voltage for driving the liquid crystal is lowered, and then, less electric power is consumed by the liquid crystal drive controller. However, a change in the voltage for driving the liquid crystal results in a change in the optimum drive bias ratio, making it impossible to obtain a favorable display contrast Under the unchanged drive condition. Besides, if only the duty for driving the liquid crystal is simply lowered, then, the-display position of the character font is fixed to the uppermost row, causing a problem of poor balance of view from the standpoint of display.

Japanese Utility Model Laid-Open No. 131786/1990 discloses a liquid crystal matrix display device having a 4-power boosting circuit and a 6-power boosting circuit, and for selecting either of the boosting circuits depending upon the duty for driving the liquid crystal. Japanese Patent Laid-Open No. 119385/1991 discloses a liquid crystal display circuit capable of being switchably driven by a plurality of power supplies such as an AC power supply, battery, etc., by which the device is driven in case of power failure, and minimum of information such as a time piece and the like are displayed at a decreased drive duty with a lowered bias.

It is an object of the present invention to provide a liquid crystal display controller mounted in an electronic device, wherein the duty for driving the liquid crystal is dynamically changed depending upon the operation state of the system in order to decrease a total amount of electric power consumed by the system, and, when a variable duty display is made, an optimum liquid crystal drive voltage and an optimum liquid crystal drive bias condition are easily set depending upon the duty for driving liquid crystal.

Another object of the present invention is to provide a liquid crystal display controller capable of dynamically varying the boosting power of the boosted voltage, the duty for driving the liquid crystal, the bias for driving the liquid crystal and the liquid crystal display position, and a system using the above liquid crystal display controller.

A further object of the present invention is to provide a liquid crystal display controller capable of producing a display that is most easily viewed depending upon the operation state of the system and a system using the above liquid crystal display controller.

Representative aspects of the invention disclosed in this application will be briefly described below.

In the liquid crystal display controller are provided a drive duty selection register (also referred to as display line control register) that can be rewritten from a microprocessor and a drive bias selection register. In a liquid crystal display panel capable of displaying 4 rows, when the whole surface display (e.g., 4-row display) is changed to the display of a few rows only (e.g., 1-row display), preset values of the drive duty selection register and of the drive bias selection register are dynamically changed by the microprocessor. Thus, part of the liquid crystal display panel is selectively displayed at a low voltage on a low-duty drive.

A value set in the drive duty selection register can be regarded as data for specifying or controlling the number of rows to be displayed on the liquid crystal panel. Due to this specifying data, the number or kind of common shift registers to be used is selected.

Concretely speaking, in a common shift register (see FIG. 9) connected to a common driver which outputs a selection level for every line in a time-division manner, the shift register selection data are successively shifted to only the shift registers (F/F1 to F/F9) corresponding to a portion (e.g., portion for displaying one row) for producing a display on the screen of the liquid crystal panel. On the other hand, the shift registers of a portion corresponding to the non-display portion on the screen of the liquid crystal panel do not undergo the shifting operation.

The preset value of the drive duty selection register is also used for setting the period of the shift clocks of the common shift register. That is, in a liquid crystal display panel capable of displaying 4 rows, when the display period of one frame in the whole surface display (4-row display) is, for example, 80 Hz, the display period of one row or two rows is 80 Hz as shown in FIG. 10 though the display is produced on one row or on two rows in order to prevent crosstalk.

Moreover, the liquid crystal display controller is provided with a boosting circuit capable of changing the boosting power as desired. The boosting power of the boosting circuit is controlled by a boosting power selection register provided in the liquid crystal display controller. When the liquid crystal display panel is changed from the whole surface display to the display of a portion thereof only, a preset value of the boosting power selection register is dynamically changed by the microprocessor, so that the boosted voltage outputted from the boosting circuit is lowered. The boosting circuit has only one output terminal contributing to decreasing the number of terminals of the liquid crystal display controller and, hence, to decreasing the cost of the liquid crystal display controller.

By using the above-mentioned means, only part of the rows on the liquid crystal display panel can be selectively driven (at a low duty) by the instruction by the microprocessor, making it possible to lower the operating frequency of the common shift register and the voltage for driving the liquid crystal. This makes it possible to suppress a total amount of electric power consumed by the liquid crystal display controller. Moreover, owing to the provision of a drive bias selection register, an optimum drive bias can be changed with a change in the drive duty, making it possible to prevent the contrast from lowering. When the liquid crystal display panel is driven at a low duty, furthermore, the boosting power of the boosting circuit can be set at a low value in accordance with a preset value of the boosting power-selection register, lowering the boosted voltage to a minimum required limit. This makes it possible to lower the operation voltage of the liquid crystal drive power supply circuit, improving the efficiency of the boosting circuit and, hence, further suppressing the electric current consumed by the liquid crystal display controller.

Desirably, furthermore, a centering display instruction register is provided in the liquid crystal display controller. The preset value of the centering display instruction register is selectively set by the microprocessor. This makes it possible to display dot-matrix characters at a position easiest to view, e.g., at the central portion of the liquid crystal display panel in the stand-by state of the system such as a portable telephone set. In the case of, for example, a liquid crystal panel capable of displaying dot-matrix characters on 4 rows, the display can be controlled so as to display only on the second row from the above, only on the second and third rows from the above, etc. When the display is produced only on the second row from the above or only on the second and third rows from the above, corresponding common signal lines are driven at a selection level. For the rows (non-display rows) that are not selected as display rows, the common signal lines are driven at a non-selection level. In this case, the preset value of the centering display instruction register and the preset value of the drive duty selection register are fed to the shift control circuit (see FIG. 9) of the common shift register, and a plurality of specified flip-flops are selected in the common shift register.

BRIEF DESCRIPTION OF THE DRAWINGS

FIG. 14(J) is a diagram of preset values of a contrast adjusting register 35 and the resistances set thereby;

FIG. 23 is a diagram illustrating preset values of a drive duty selection register 34 and the state of display of the embodiment of FIG. 21;

PREFERRED EMBODIMENTS

Figure 1:
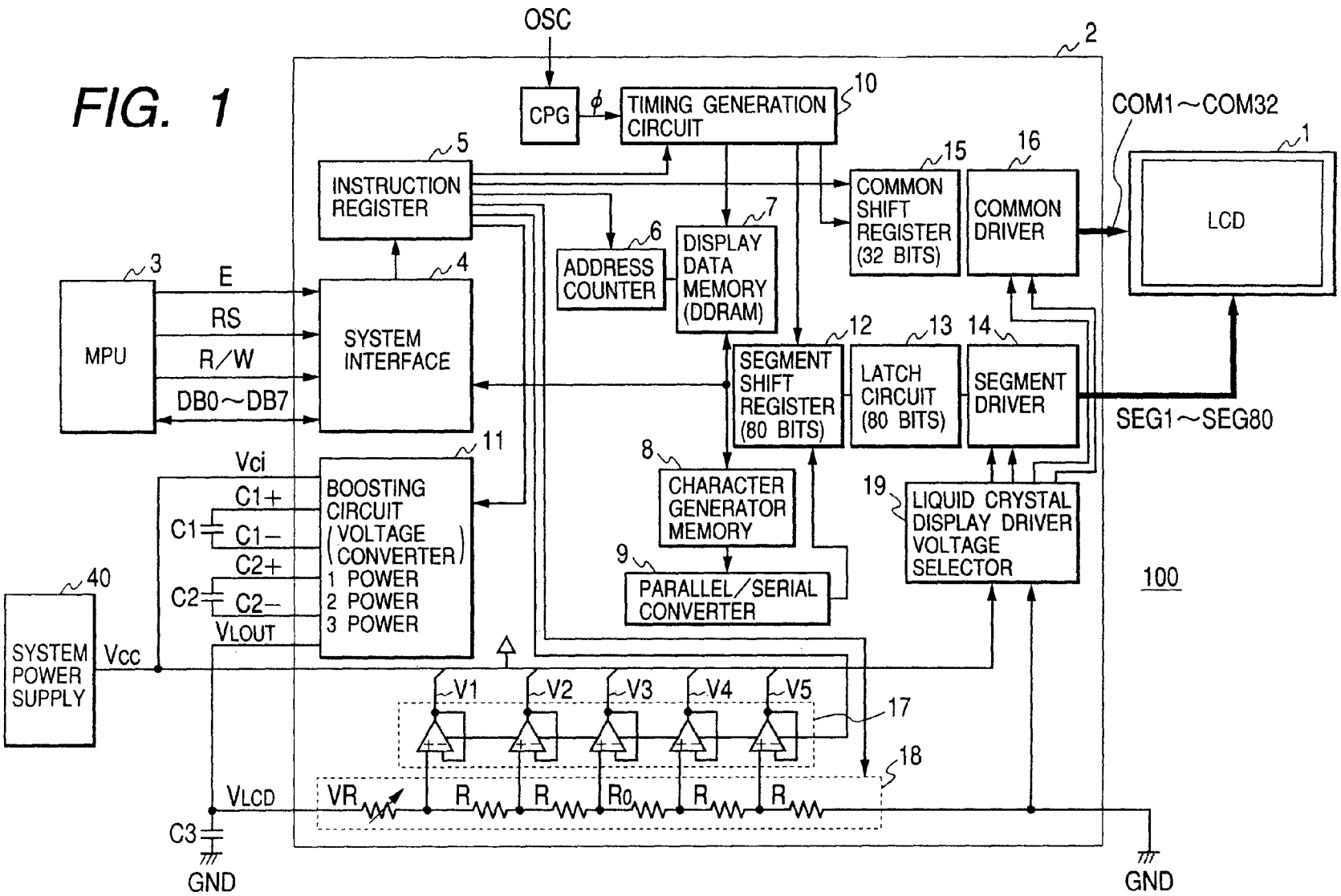
FIG. 1 is a block diagram illustrating a liquid crystal display system of an embodiment according to the present invention.

FIG. 1 shows a liquid crystal display system (liquid crystal display device) 100 of an embodiment according to the present invention. The display system 100 includes a liquid crystal display panel 1 of dot-matrix type, a liquid crystal display controller 2 that outputs signals for driving common electrodes and segment electrodes of the liquid crystal display panel (or liquid crystal display: LCD) to produce a display, a microprocessor (MPU) 3 that sets control data in the liquid crystal display controller 2 and writes display data, and a system power supply 40 such as a battery. Between the microprocessor 3 and the liquid crystal display controller 2 are provided control signal lines for transmitting an enable signal E for activating the controller chip 2, a reset signal RS for instructing a reset, and a read/write control signal R/W from the MPU 3 to the controller 2, and a data bus for transferring data signals DB0 to DB7 of 8 bits between the MPU 3 and the controller 2. The liquid crystal display panel 1 and the liquid crystal display controller 2 are connected together through common signal lines COM1 to COM32 and segment signal lines SEG1 to SEG80.

The liquid crystal display controller 2 includes a system interface circuit 4 for transferring signals to and from the microprocessor 3 that includes a central processing unit (CPU), an instruction register 5 for setting internal control data, a display data RAM (display memory) 7 for storing character codes of characters displayed on the screen of the liquid crystal panel 1, an address counter 6 for reading out display data from the display data RAM 7 in accordance with the drive positions of the liquid crystal display panel 1, a character generator memory 8 for expanding a character font pattern in the form of a dot-matrix from the character codes read out from the display data RAM 7, a parallel/serial converter circuit 9 for converting display data of a plurality of bits read out from the character generator memory 8 into serial data, a segment shift register 12 for shifting the converted display data and for holding one line of shifted display data, a latch circuit 13 for holding one line of shifted display data, a segment driver 14 for generating and outputting drive voltage waveforms applied to the segment electrodes of the liquid crystal display panel 1 based upon the display data that are being held, a common shift register 15 for generating signals for successively selecting common electrodes of the liquid crystal display panel 1, a common driver 16 for generating and outputting drive voltage waveforms applied to the common electrodes, a timing generation circuit 10 for generating timing signals that specify display positions for the display data memory 7 and for generating clock signals that give display timings for the shift registers 12 and 15, a boosting circuit 11 for generating a liquid crystal drive voltage based on a power supply voltage Vci from the system power supply 40, a liquid crystal drive bias circuit 18 for generating a liquid crystal drive bias voltage based on the boosted voltage, a power supply circuit 17 made up of a voltage follower (operational amplifier) that subjects the bias voltage generated by the liquid crystal drive bias circuit 18 to the impedance conversion and outputs it, and a liquid crystal drive voltage selection circuit 19 that selects a desired bias voltage out of bias voltages generated by the power supply circuit 17 and supplies it to the segment driver circuit 14 and to the common driver circuit 16. Upon receipt of a clock CLK supplied from an external unit, a clock pulse generation circuit CPG outputs an internal clock 0 to the timing signal generation circuit 10.

The liquid crystal display controller 2 is formed on a semiconductor chip as a semiconductor integrated circuit (LSI) of complementary metal/insulating film/semiconductor field-effect transistors (CMOS) by using a known technology for fabricating semiconductor integrated circuits. In FIG. 1, C1 and C2 denote capacitive elements constituting a boosting circuit, and C3 denotes a capacitive element for stabilizing the power source. These capacitive elements do not have a sufficient capacitance when they are formed on the semiconductor chip and are, hence, externally attached capacitive elements. Their capacitances is, for example, 1 microfarad (μF). The character generator memory 8 is generally constituted by a ROM (read-only memory). In order that a pattern prepared by the user can be displayed, however, a RAM (random access memory) is often added to the ROM. Though there is no particular limitation, the segment shift register 12 and the common shift register 15 are constituted by bidirectional shift registers.

In the liquid crystal display controller 2 of this embodiment, the microprocessor 8 writes, through the system interface 4, the code of a character to be displayed on the display data RAM 7, correspondingly to the display positions, so that any character stored in the character generator memory 8 can be displayed. When the microprocessor 3 sets various control data for producing liquid crystal display in the instruction register 5 via the system interface 4, the controller controls the display in accordance with control data that have been set. Writing the data in the display data RAM 7 is started as the microprocessor 3 sets the first address of the character string to be displayed in the address counter 6. Thereafter, the address counter 6 automatically updates the address, and the character codes input from the microprocessor 3 are successively written in the display data RAM 7.

The display data (character codes) are successively read out as the display address signals generated by the timing generation circuit 10 are sent to the display data RAM 7, and the character patterns stored in the character generator memory 8 are read out, with the character codes as addresses. Furthermore, the character patterns are converted into serial data through the parallel/serial converter 9, and successively sent to the segment shift register 12 in the segment drive circuits (12, 13, 14). When one line of data are stored in the segment shift register 12, the data is latched in the latch circuit 13 simultaneously, the segment driver 14 selects a turn-on/turn-off voltage from the latched data and outputs it to the liquid crystal display panel 1. The level of the turn-on/turn-off voltage is generated by the liquid crystal drive voltage selector 19.

Figure 2:
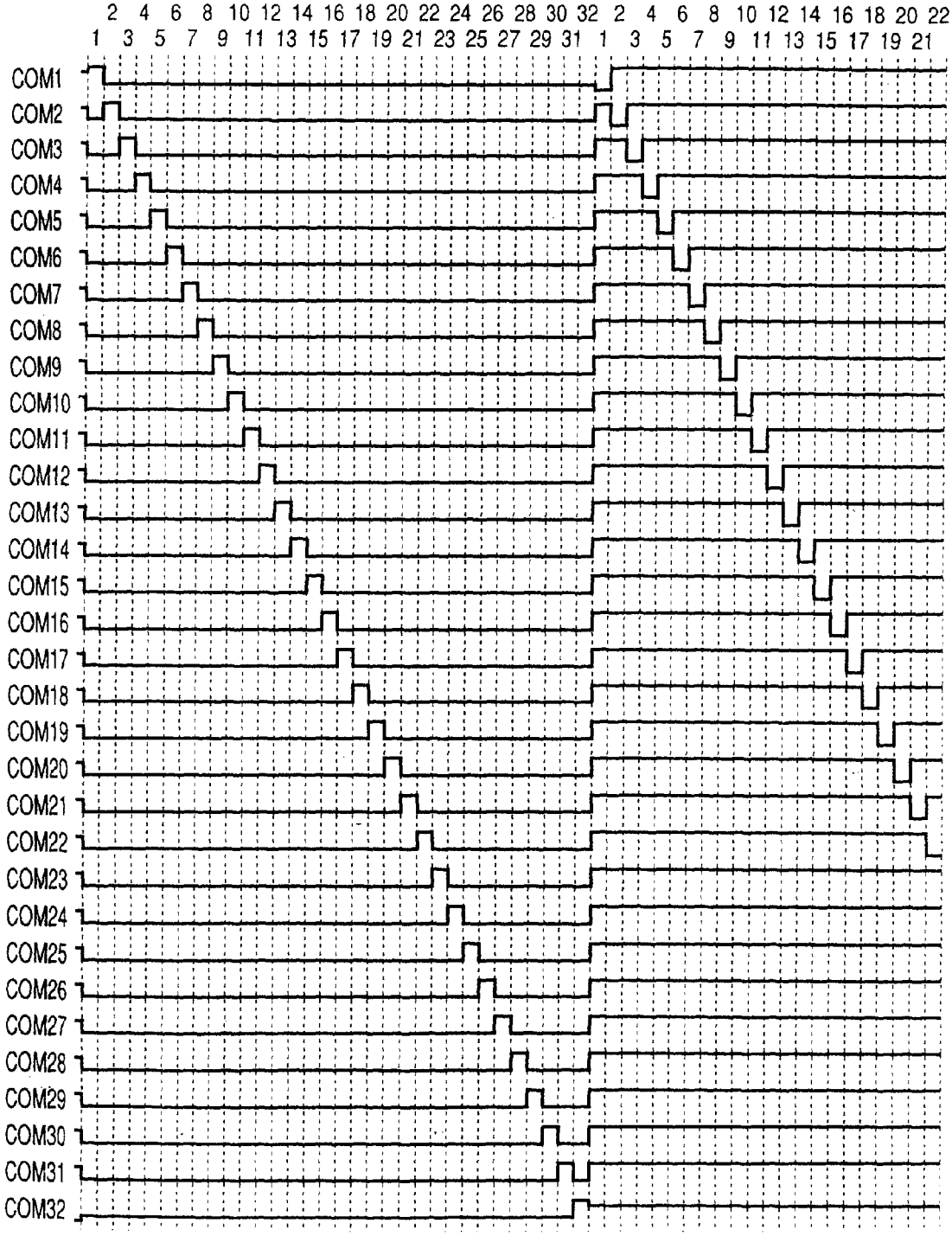
FIG. 2 is a diagram of output waveforms of a common driver at the time of 1/32 duty drive (4-row display)

When a character font pattern constituted by, for example, 5×8 dots is displayed in 4 rows in the vertical direction, the common driver 16 requires a total of 32 output circuits since each display row has 8 lines. As shown in FIG. 2, the common driver 16 successively outputs common drive signals (COM1 to COM32) of the selection voltage level for the liquid crystal display panel 1 in a time-division manner from COM1 to COM32. In this case, COM1 to COM8 are for the first row, COM9 to COM16 are for the second row, COM17 to COM24 are for the third row, and COM25 to COM32 are for the fourth row.

In the liquid crystal display panel 1 capable of producing a display of up to four rows, the whole-surface display using four rows is not-in many cases required in the stand-by state of the system. During the stand-by period, for example, data such as time and date only are displayed on two rows or on one row. In a conventional liquid crystal display controller, the common drive signal has been output even to the rows in which no display is produced and a voltage of the turn-off level has been applied to the segment electrodes. Accordingly, the consumption of electric power has not been able to be decreased though the display is produced on a decreased number of rows only. According to the present invention, the common shift register 12 is so operated that the common drive signal is not applied to the rows in which no display is produced. This makes it possible to decrease the amount of electric power consumed by the liquid crystal display controller 1 in the stand-by state.

Figure 3:
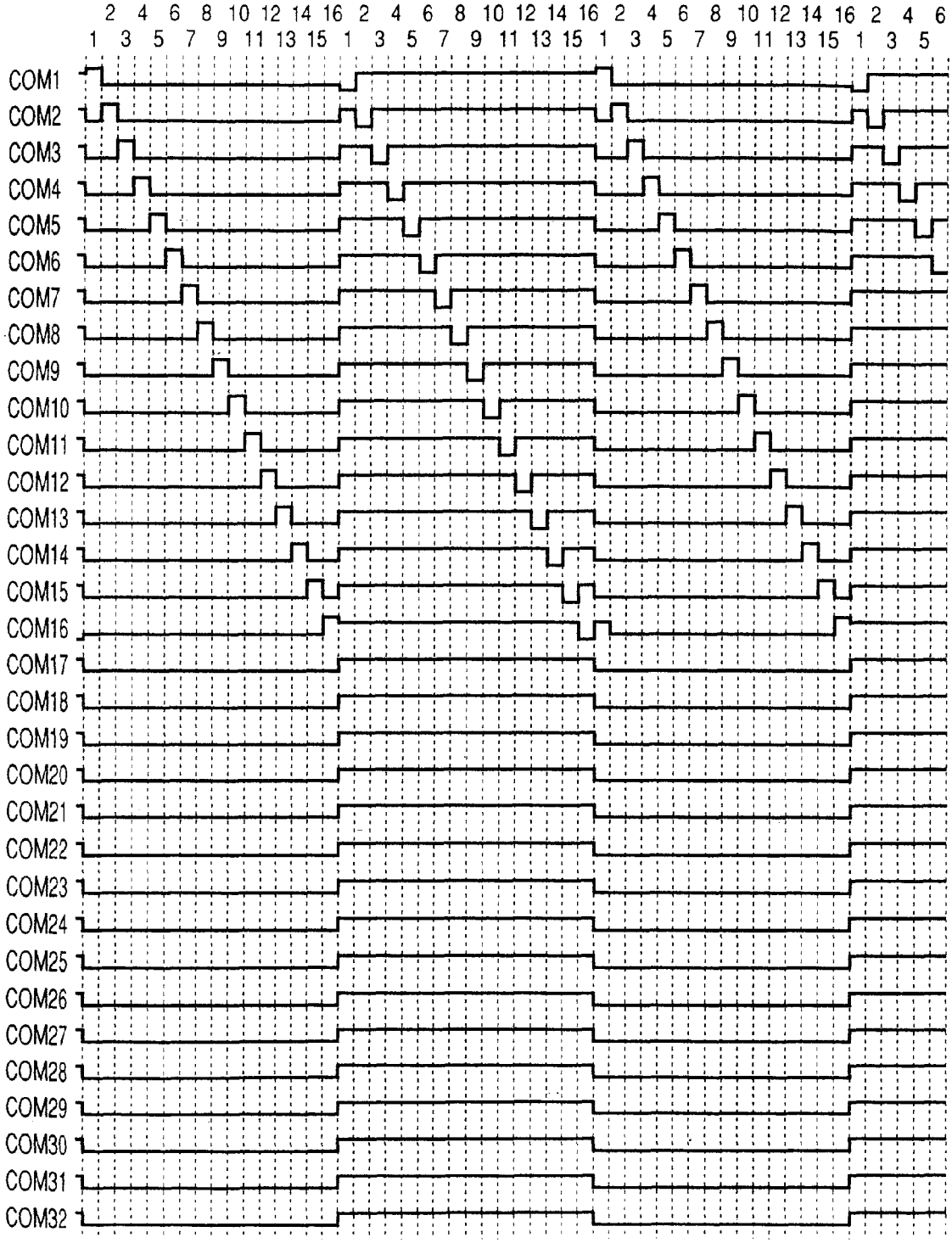
FIG. 3 is a diagram of output waveforms of the common driver at the time of 1/16 duty drive (2-row display) from COM1.
Figure 4:
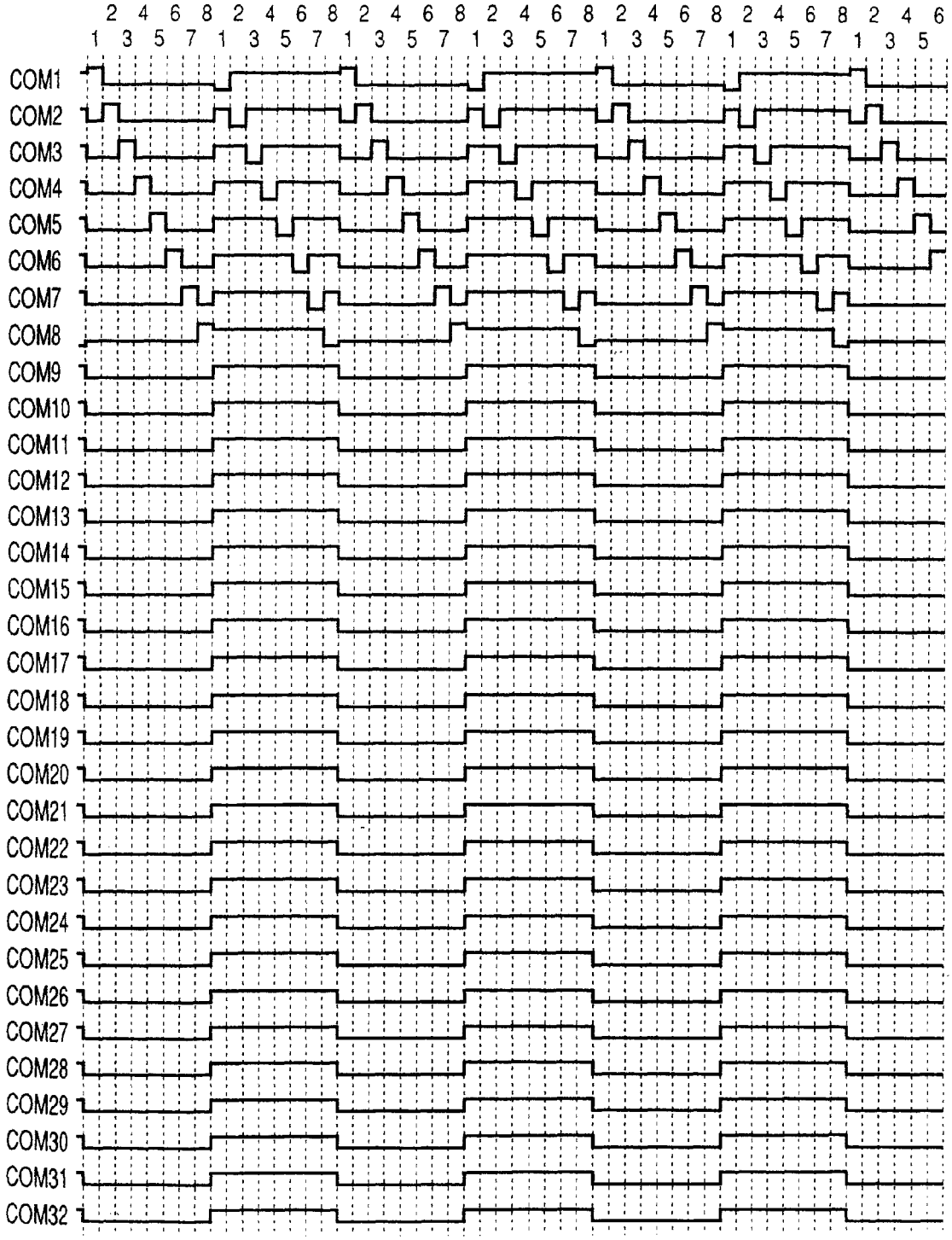
FIG. 4 is a diagram of output waveforms of the common driver at the time of 1/8 duty drive (1-row display) from COM1.
Figure 5A:
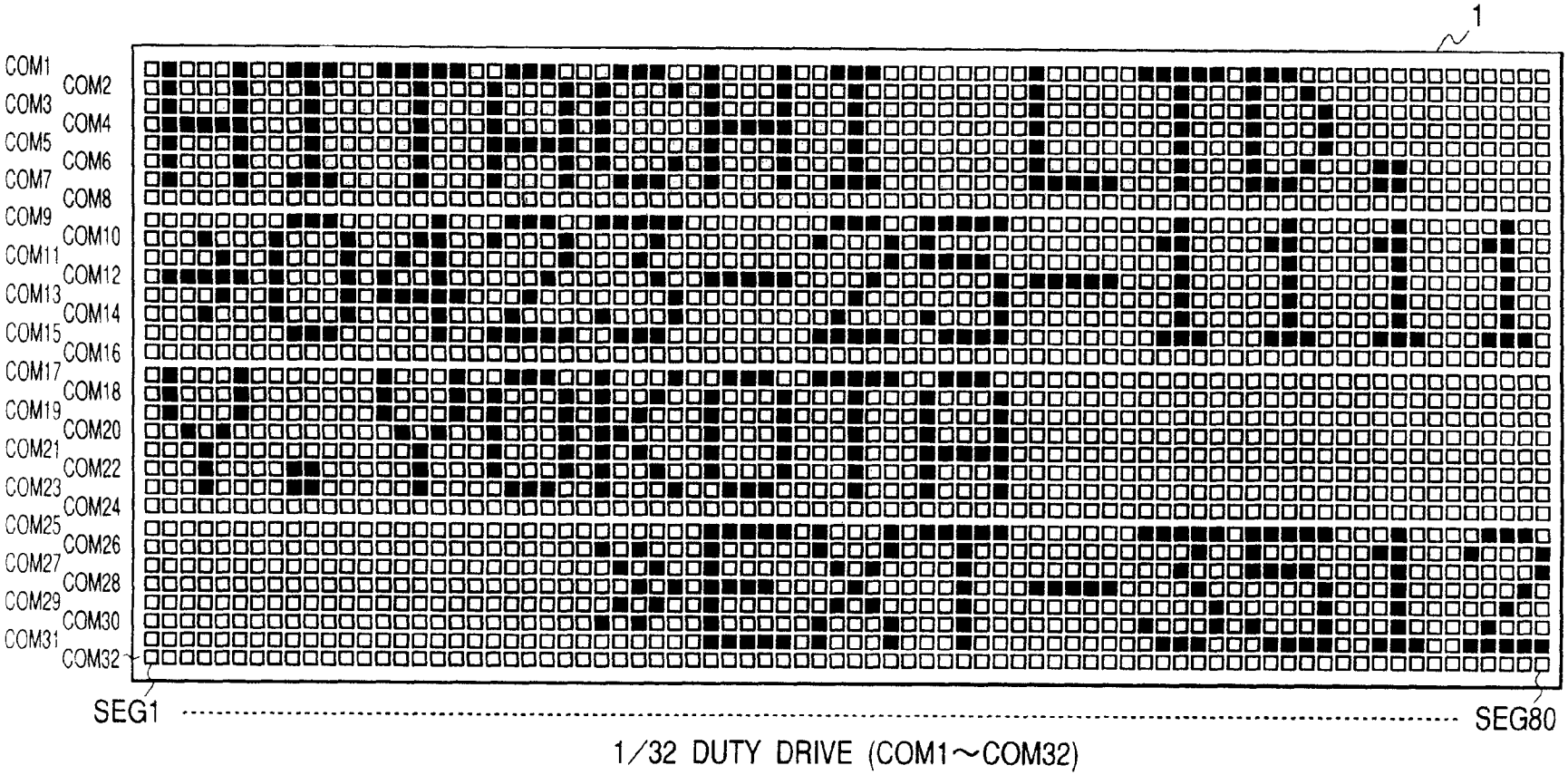
FIGS. 5(*a*), 5(*b*) and 5(*c*) are diagrams of displays on a liquid crystal display panel at the time of 1/32, 1/16 and 1/8 duty drives from COM1.
Figure 5B:
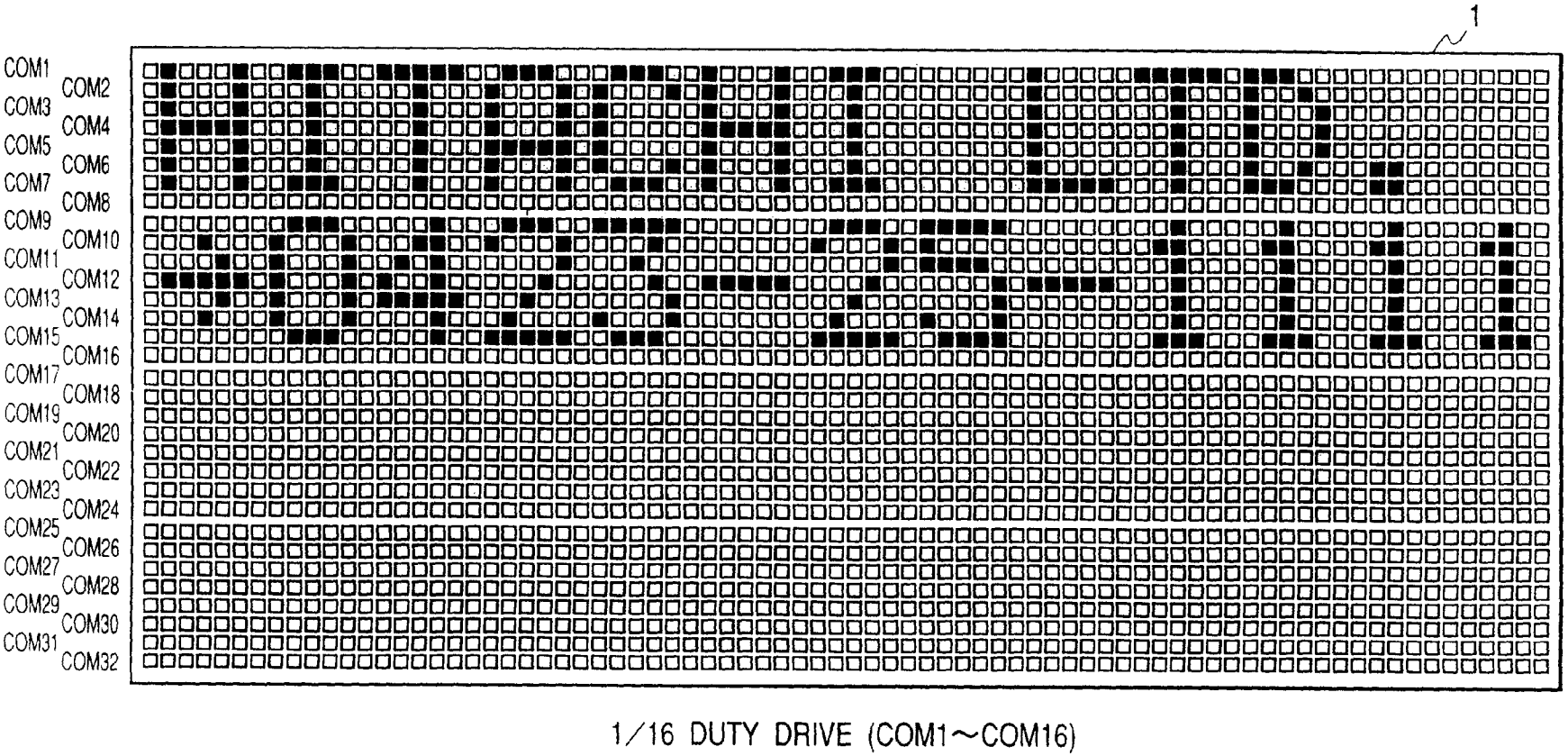
Figure 5C:
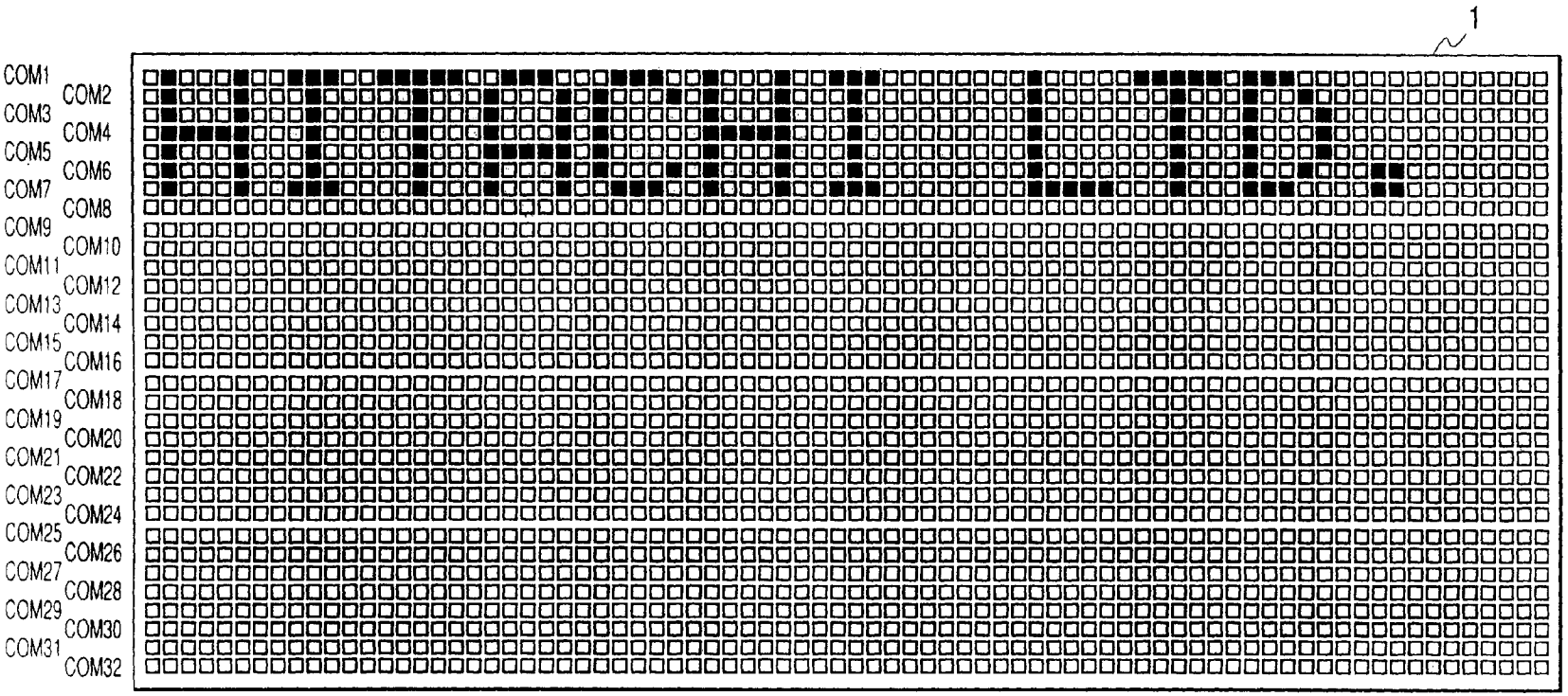

In this case, too, however, the selection level is output in the ranges of from COM1 to COM16 (1/16 duty drive) and from COM1 to COM8 (1/8 duty drive) as shown in FIGS. 3 and 4 when the common drive signal of the selection level is successively output starting from COM1 to produce a display on two rows or on one row. This, however, produces a display on the upper 2 rows or 1 row on the screen of the 4-row liquid crystal display panel 1 as shown in FIGS. 5(*b*) and 5(*c*), deteriorating the appearance. FIG. 5(*a*) shows a display in 4 rows in the case of 1/32 duty drive.

Figure 6:
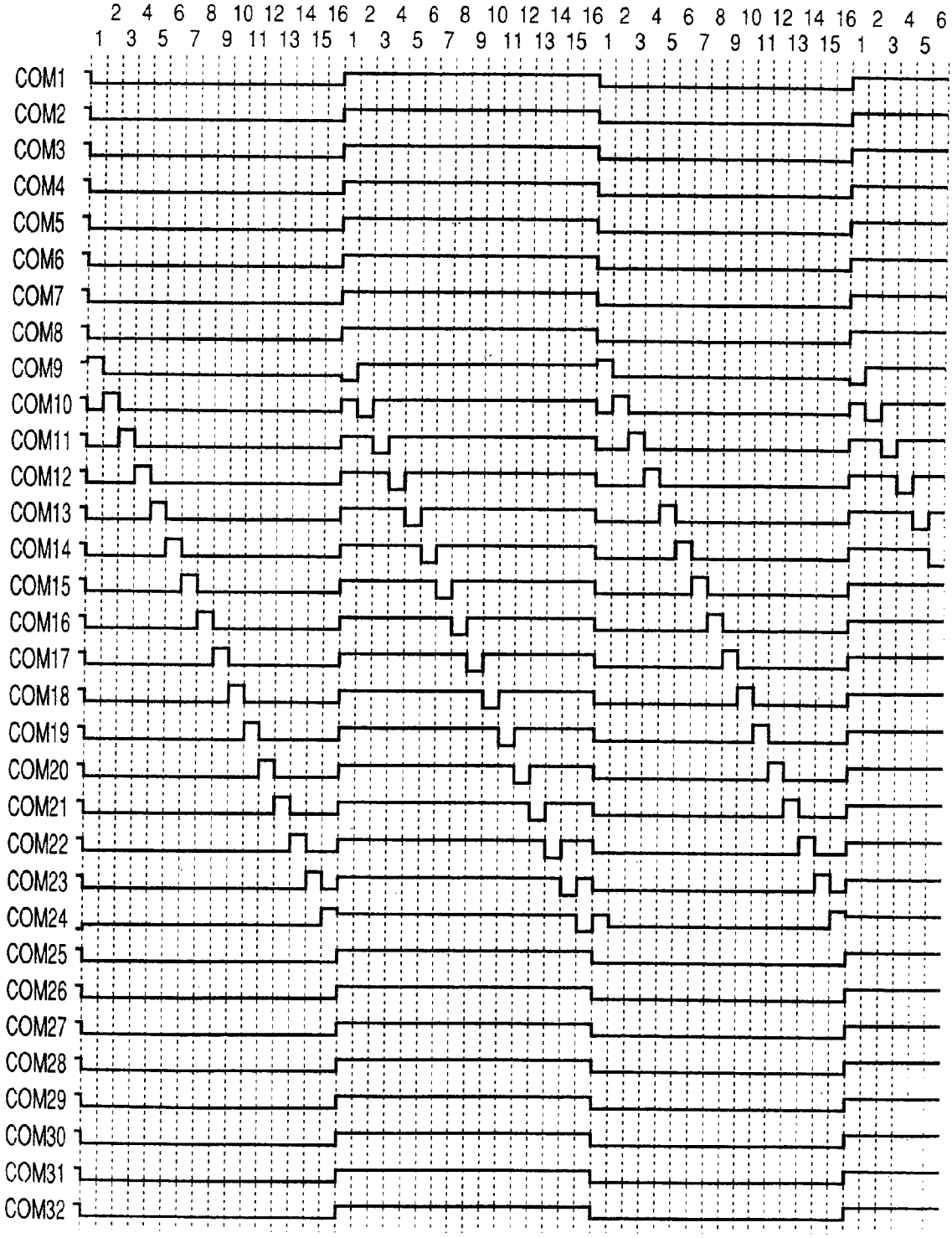
FIG. 6 is a diagram of output waveforms of the common driver at the time of 1/16 duty drive (2-row display) from COM9.
Figure 7:
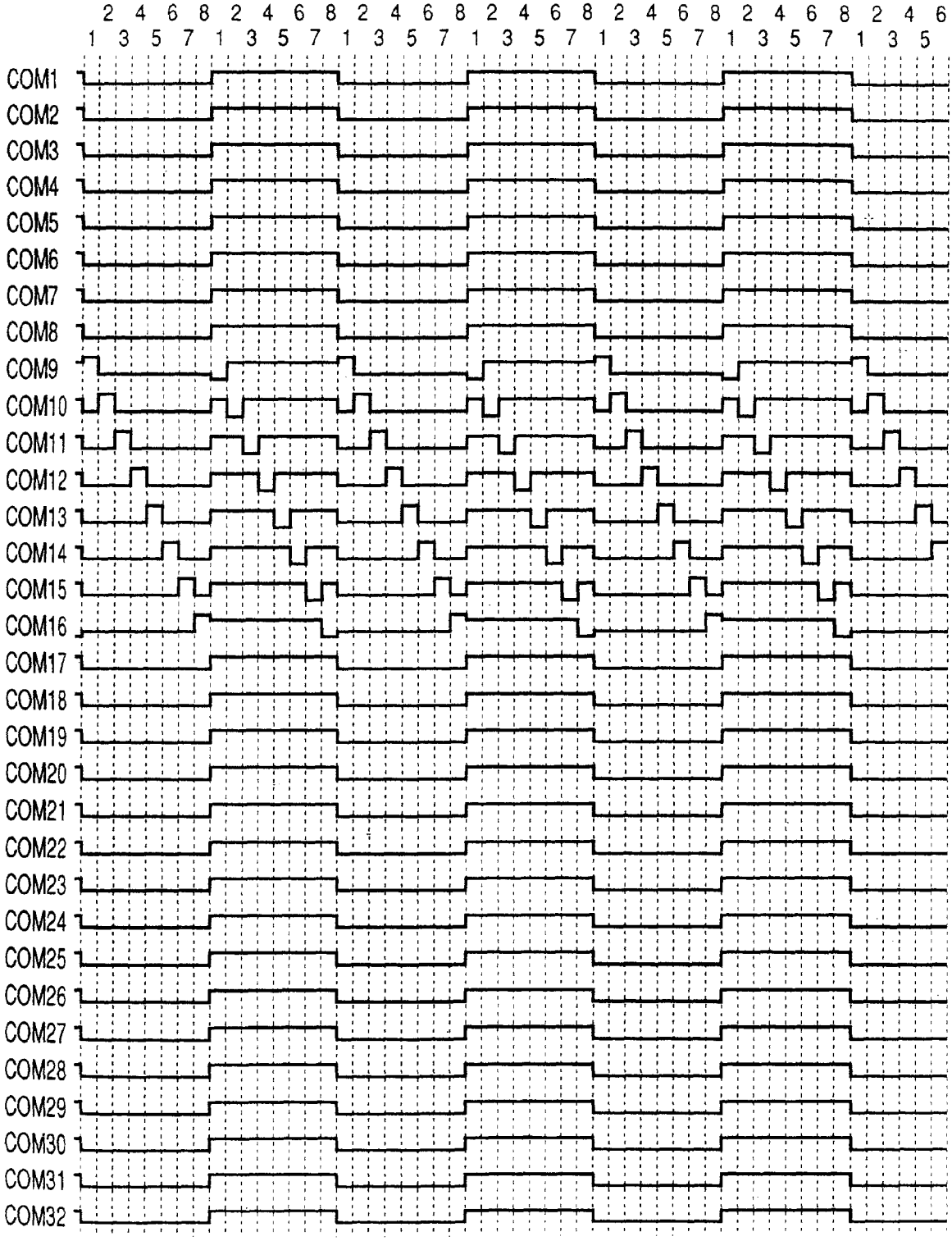
FIG. 7 is a diagram of output waveforms of the common driver at the time of 1/8 duty drive (1-row display) from COM9.
Figure 8A:
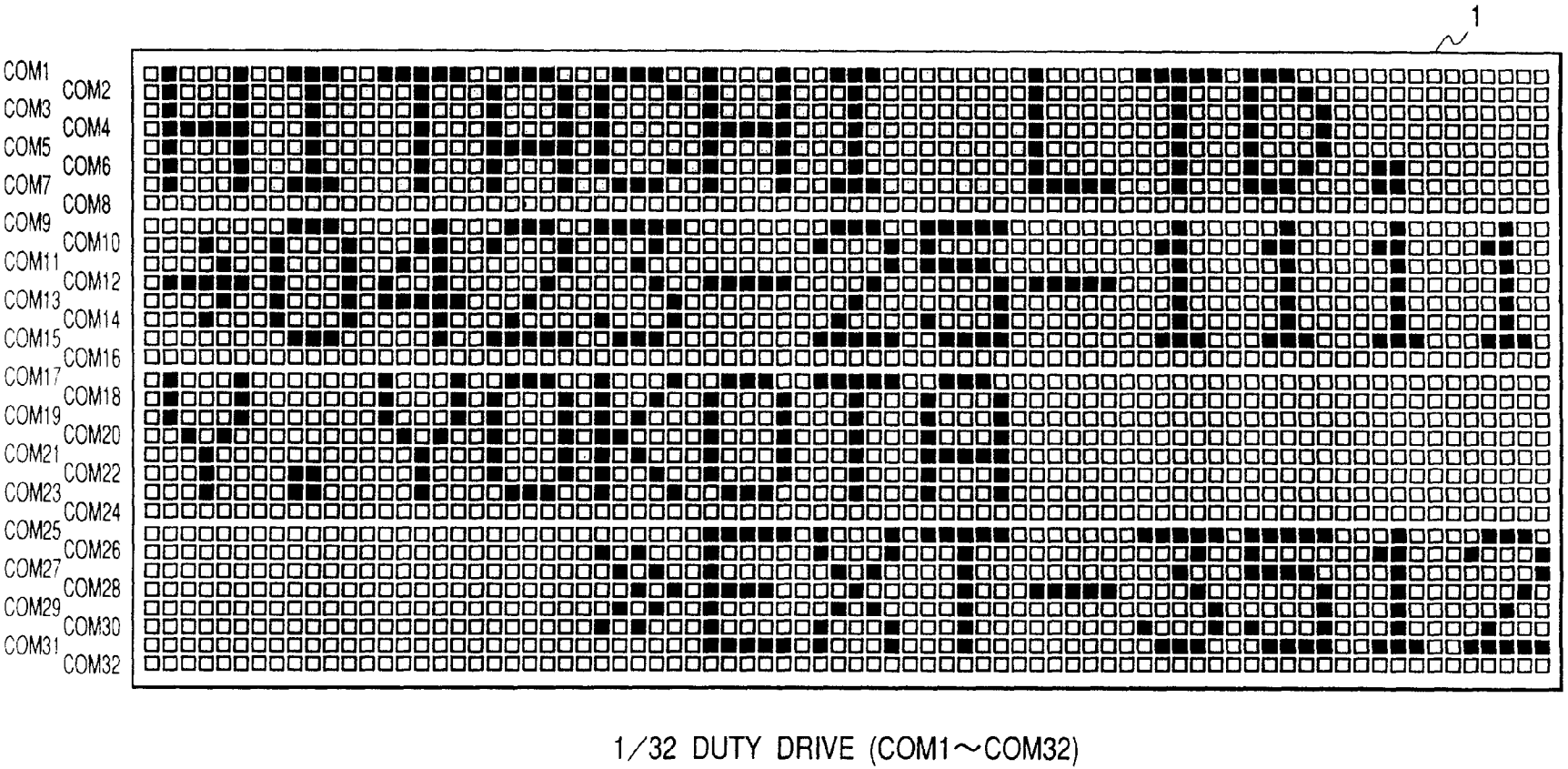
FIGS. 8(*a*), 8(*b*) and 8(*c*) are diagrams of displays on the liquid crystal display panel at the time of 1/32, 1/16 and 1/8 duty drives from COM9.
Figure 8B:
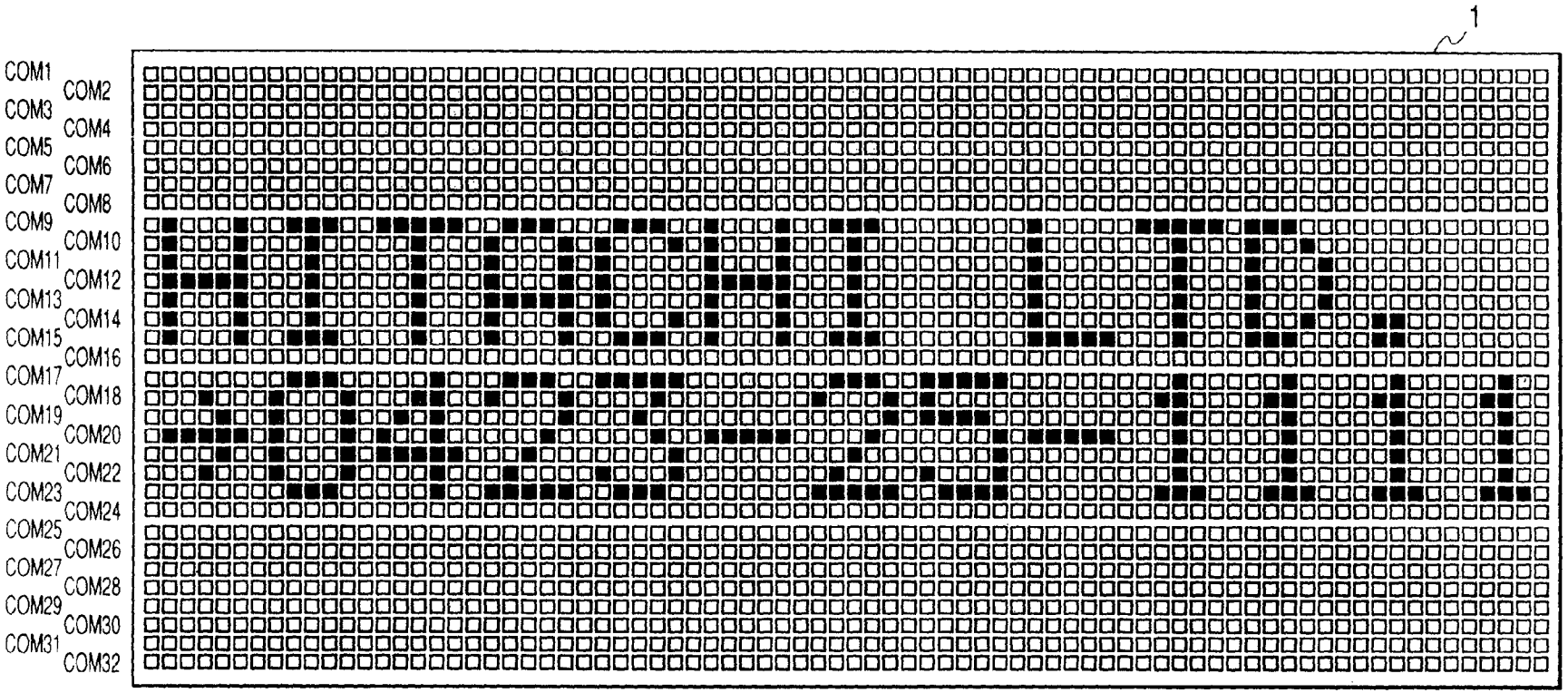
Figure 8C:
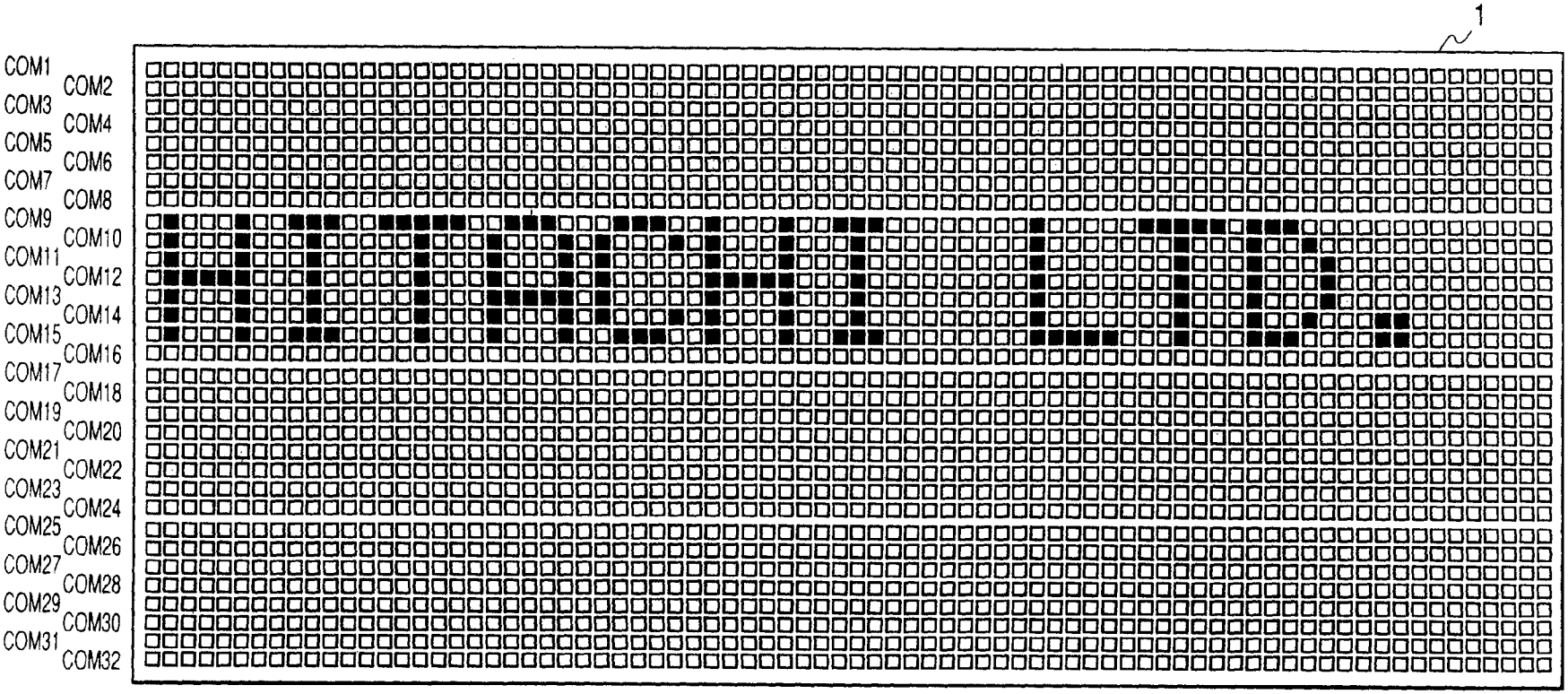

In this embodiment, therefore, when the display is produced on 2 rows or on 1 row, the selection drive from the common drive signal COM1 up to the common drive signal COM8 is skipped as shown in FIGS. 6 and 7, and the selection level is output in a range of from COM9 to COM24 (1/16 duty drive) or from COM9 to COM16 (1/8 duty drive), in order to operate the common shift register 15 so that the display may be selectively produced on the central portion of the screen of the liquid crystal display panel 1 as shown in FIGS. 8(*b*) and 8(*c*). Besides, in this case, the non-display rows other than the display area at the central portion of the screen are driven on an alternating current of the non-selection level at all times in order to prevent the problem that the liquid crystal is deteriorated and the display is blackened when a DC bias is applied to the liquid crystal. FIG. 8(*a*) shows a 4-row display in the case of the 1/32 duty drive.

Figure 9:
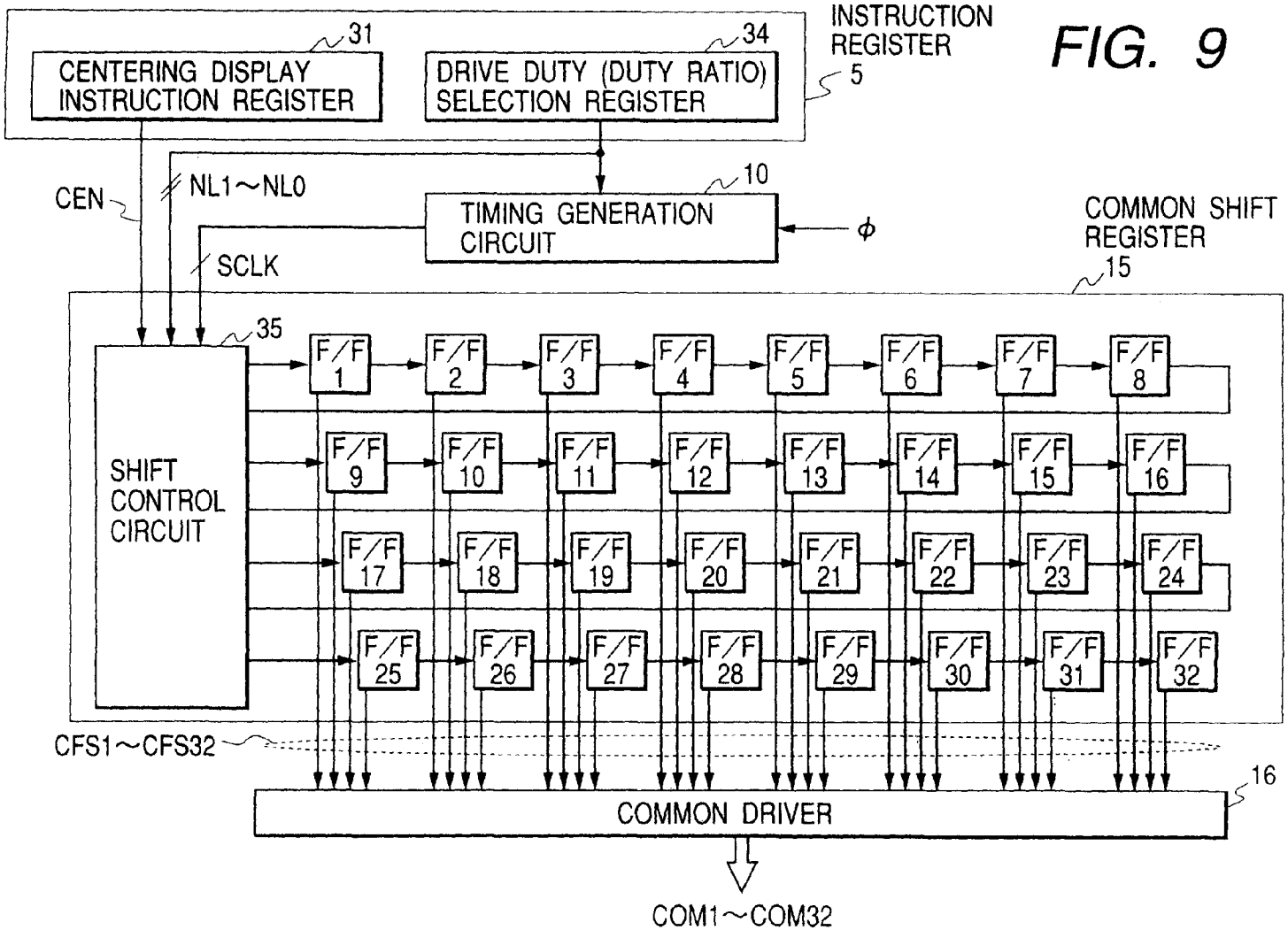
FIG. 9 is a diagram illustrating in detail the circuit of a common shift register for producing a display on the central portion of the display panel.

FIG. 9 is a diagram illustrating in detail a method of producing a display on the central portion of the screen during the low-duty drive. The instruction register 5 of FIG. 1 includes a drive duty selection register (display row control register) 34 in which a drive duty value is set and a centering display instruction register 31 for instructing that the display be selectively produced on the central portion of the display screen.

The drive duty selection register 34 has, for example, two control bits NL1 and NL0, and selects a 4-row display (1/32 duty drive) when the value of NL1 and NL0 is "00", selects a 2-row display (1/16 duty drive) when the value is "01", and selects a 1-row display (1/8 duty drive) when the value is "10". The centering display instruction register 31 has a control bit CEN, and does not select the central display when the value of CEN is "0" and selects the central display when the value is "1".

The microprocessor 3 sets predetermined values in the drive duty selection register 34 and in the centering display instruction register 31. Based on the drive duty value in the drive duty selection register 34, the liquid crystal display controller 2 adjusts the period of a shift clock signal SCLK of the common shift register 15 generated by the timing generation circuit 10. For example, when the drive duty is changed from the 4-row display to the 2-row display, the period of the shift clock is doubled in order to maintain constant the frame period which is, for example, 80 Hz. When the drive duty is changed to 1-row display, furthermore, the period of the shift clock is lengthened four times. That is, the timing generation circuit 10 includes a clock frequency-dividing circuit capable of varying the frequency-dividing ratio. The frequency-dividing ratio of the clock frequency-dividing circuit is controlled based upon the drive duty value set in the drive duty selection register 34.

The drive duty value set in the drive duty selection register 34 is also supplied to the shift control circuit 35 to select a plurality of flip-flops among the flip-flops F/F1 to F/F32 according to the drive duty value that is set. The flip-flops F/F1 to F/F8 are used for producing a display on the first row of the liquid crystal panel 1, the flip-flops F/F9 to F/F 16 are used for producing a display on the second row of the liquid crystal panel 1, the flip-flops F/F17 to F/F24 are used for producing a display on the third row on the liquid crystal panel 1, and the flip-flops F/F25 to F/F32 are used for producing a display on the fourth row on the liquid crystal panel 1. Therefore, when the value of control bit CEN of the centering display instruction register 31 is "0", the flip-flops F/F1 to F/F32 are selected by the shift control circuit 35 in the case of the 4-row display (1/32 duty drive), the flip-flops F/F1 to F/F16 are selected by the shift control circuit 35 in the case of the 2-row display (1/16 duty drive), and the flip-flops F/F1 to F/F9 are selected by the shift control circuit 35 in the case of the 1-row display (1/8 duty drive).

The preset value of the centering display instruction register 31 is supplied to the shift control circuit 35 which, at the time of a normal whole-surface display (4-row display), shifts the value "1" used as a shift register selection data from the flip-flop F/F1 to the flip-flop F/F32 successively, so that common signals of the selection level are output in a time-division manner from the common driver 16. During the period in which the shift register selection data "1" is being input, the flip-flops F/F1 to F/F32 selectively output signals CSF1 to CSF32 of the selection level to the common driver 16. Therefore, the common driver 16 discriminates common signal lines to be at the selection level, and outputs the corresponding common signals COM1 to COM32 of the selection level. When the system such as a-portable telephone set is in the stand-by state, the shift register selection data "1" is successively shifted from, for example, the flip-flop F/F9 to the flip-flop F/F24 based on the preset value (CEN="1") of the centering display instruction register 31 and on the drive duty value (NL1–NL0="01": 2-row display (1/16 duty drive)) set in the drive duty selection register 34, so that the common driver 16 outputs common signals of the selection level to the common lines of the central two rows in a time-division manner.

Figure 10:
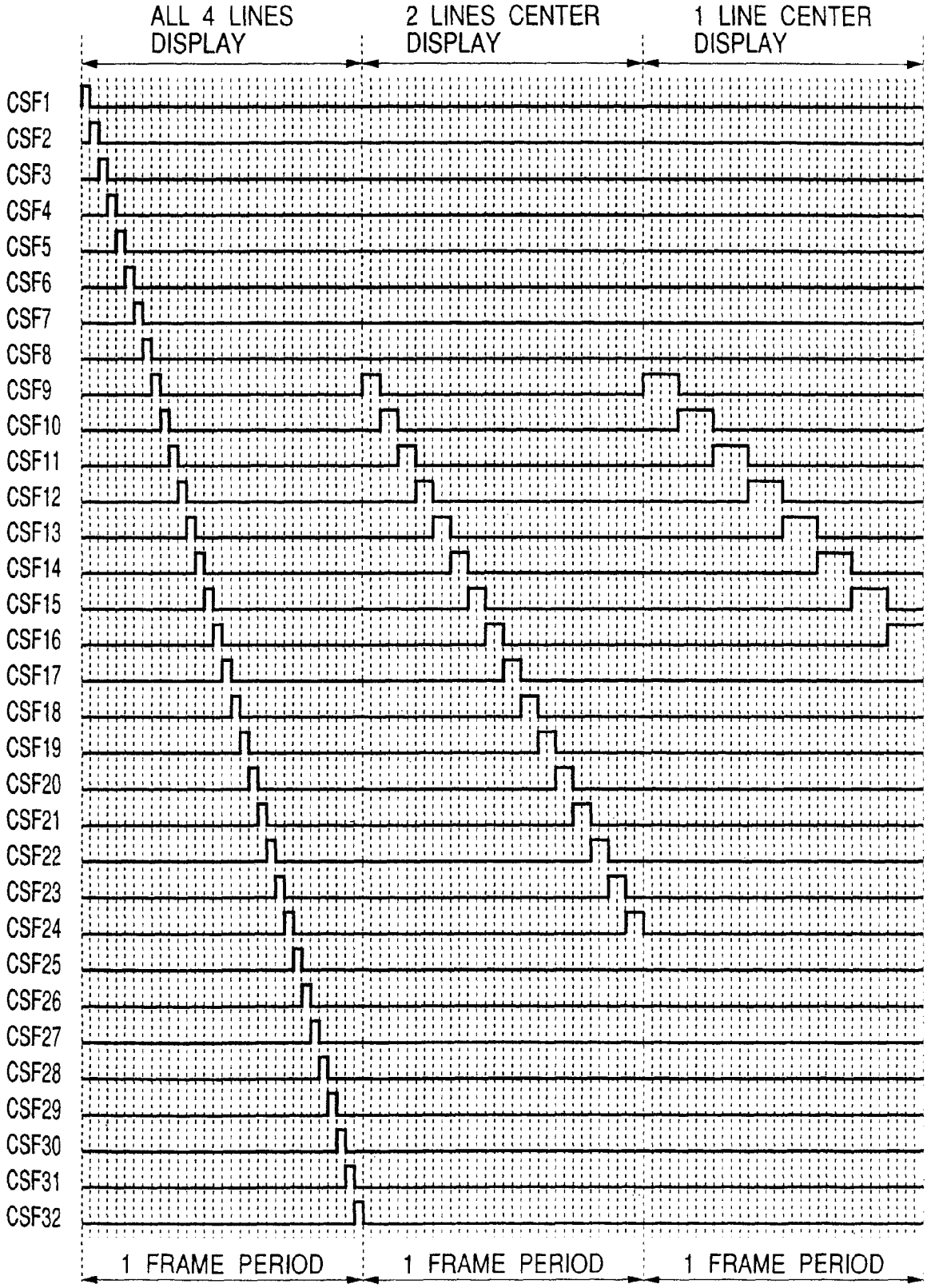
FIG. 10 is a diagram illustrating output waveform timings of the common shift register for producing a display on the central portion of the display panel.

FIG. 10 is a diagram illustrating in detail the timings of when the periods of shift clock signals of the common shift register 15 are so adjusted based upon the preset drive duty value that the period of the frame becomes constant. In the liquid crystal display controller 2 of this embodiment, the data specified by the centering display instruction register 31 and the shift clocks generated by the timing generation circuit 10 are input to the shift control circuit 35 (FIG. 9) in the common shift register 15 thereby to control the shift register constituted by 32 flip-flops (F/F1 to F/F32). In the case of the 4-row display, for example, the selection data of from F/F1 to F/F32 are successively shifted to produce a display on the whole surface. To produce a display on the central 2 rows on the screen, the shifting operation is started from F/F9 and is ended at F/F24. In this case, the flip flops F/F1 to F/F9 and F/F25 to F/F32 are reset at all times, and are not shifted. To produce a display on the central 1 row on the screen, the shifting operation is started with F/F9 and is ended at F/F16. At this moment, the flip-flops F/F1 to F/F8 and F/F17 to F/F32 are reset at all times, and are not shifted. The maintaining of the frame period constant at dissimilar drive duties provide a function of preventing crosstalk.

In general, lowering the drive duty lengthens the time taken to select the lines, and the display on the whole panel can be easily turned on. Therefore, to maintain the same contrast even after the drive duty is lowered, it is necessary to lower the liquid crystal drive voltage and the drive bias. Moreover, by lowering the liquid crystal drive voltage to decrease the drive duty, the merit of decreasing the consumption of electric power is obtained. In particular, in the liquid crystal display controller that requires a liquid crystal drive voltage higher than the voltage of the system power supply 40, it is necessary to generate the liquid crystal drive voltage by boosting the system power supply voltage. In this case, when the current is supplied to the circuits (11 to 18) of the liquid crystal drive system through the boosting circuit 11, the current consumption viewed from the system power supply side increases to, for example, two or three times the power depending upon the boosting power. Besides, the boosting efficiency of the boosting circuit 11 decreases with an increase in the boosting power. Therefore, when the current is supplied to the circuits (11 to 18) in the liquid crystal drive system through the boosting circuit 11, it is advantageous to lower the boosting power to a required minimum degree from the standpoint of suppressing the consumption of electric current.

In this embodiment, furthermore, the period of selection level of the common signals is increased two times or four times when the drive duty is decreased to 1/2 or 1/4 to produce a display on 2 rows or on 1 row. This makes it possible to lower the drive duty without changing the frequency of 1 frame. That is, a decrease only in the drive duty results in an increase in the frame frequency and a deterioration of the picture quality. In this embodiment, however, the drive duty is lowered without changing the frame frequency and avoiding a deterioration of the picture quality.

The control operation of increasing the period of selection level of the common signals to 2 times or 4 times when the drive duty is lowered to 1/2 and 1/4, can be easily realized by lowering the frequency of the clock signals supplied to the common shift register 15 from the timing generation circuit 10 down to 1/2 and 1/4. Thus, since the frequency of the clock signals is lowered when the drive duty is lowered to 1/2 and 1/4, the operating frequency of the internal circuit constituted by the CMOS circuit is lowered, producing an advantage of a decrease in the consumption of electric power.

Figure 11:
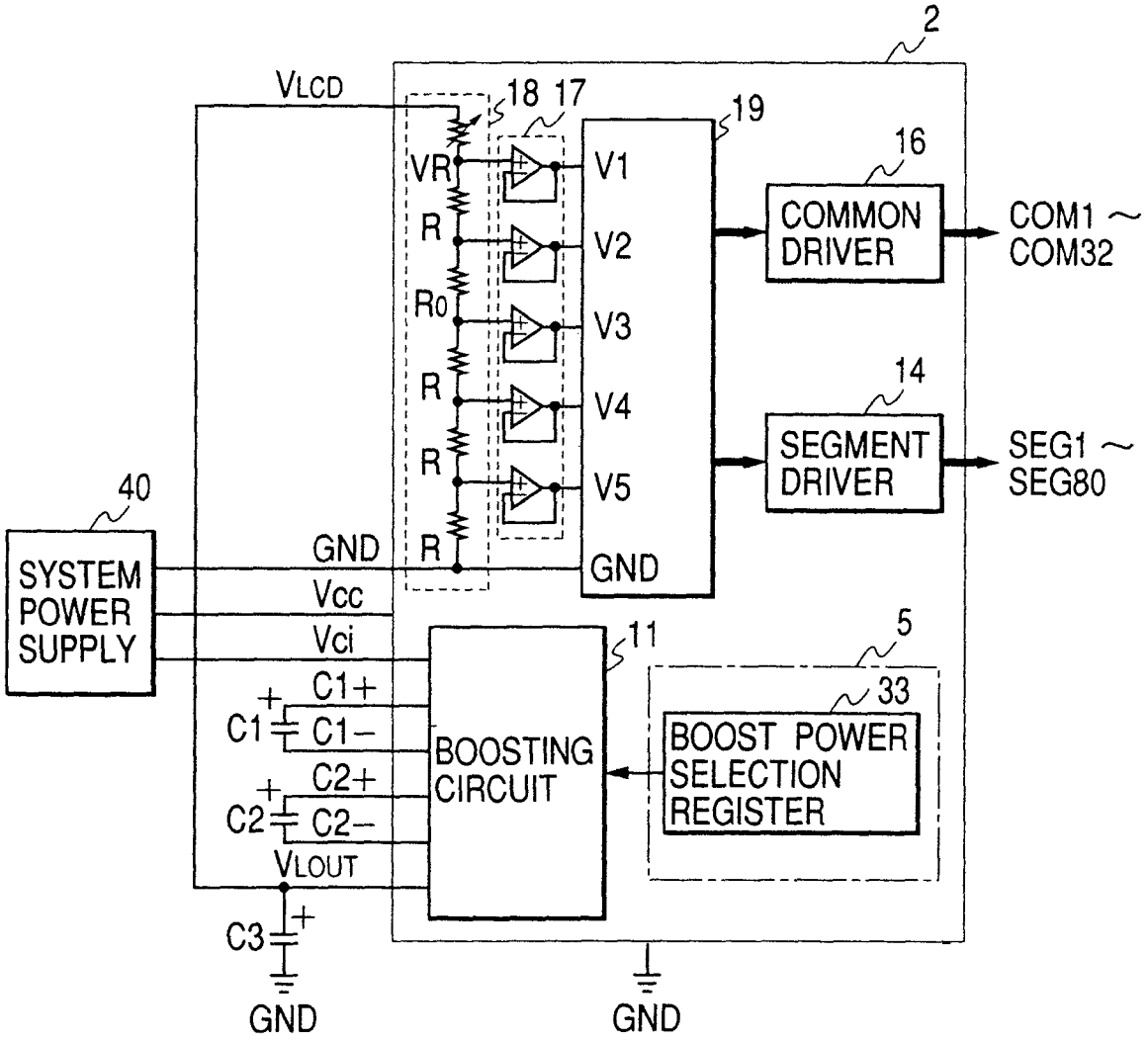
FIG. 11 is a diagram illustrating the constitution of a boosting circuit 11 for generating a liquid crystal drive voltage and of a circuit in the liquid crystal drive system.

FIG. 11 shows circuits (11 to 18) in the liquid crystal drive system. The boosting circuit 11 boosts a basic voltage supplied from an input voltage terminal Vci up to a maximum of three times and outputs it to a terminal VLOUT. Symbols C1 and C2 denote capacitors for boosting the voltage in a charge pump manner, and C3 denotes a capacitor for stabilizing the power supply. By outputting the boosted voltage from the terminal VLOUT, it is possible to decrease the number of external terminals of the liquid crystal drive controller 2 and, hence, to decrease the cost of the liquid crystal drive controller 2 and the area where-the liquid crystal drive controller 2 is provided. By using the liquid crystal drive controller 2 of the present invention, a portable telephone set of a decreased weight and a compact size can be obtained.

In this embodiment as shown, a boosting power selection register 33 is provided corresponding to the boosting circuit 11. The microprocessor 3 sets a desired boosting power in the boosting power selection register 33 in the instruction register 5, so that the boosting power of the VLOUT output of the boosting circuit 11 can be arbitrarily changed from 1 power to 3 power.

Though there is no particular limitation, the boosting power selection register 33 is provided in the instruction register 5. A basic voltage Vci may be the one (e.g., 2.8 V) lower than Vcc obtained by dividing the power supply voltage Vcc (e.g., 3 V) by using resistors. A voltage lower than the power supply voltage Vcc is used as the basic voltage Vci for the boosting circuit 11. This is because, when the liquid crystal display panel 1 of this embodiment is driven, the liquid crystal drive voltage may be about 8 V even when it is driven at the highest duty. Besides, the consumption of electric power increases with an increase in the boosted voltage as described Therefore, the voltage must not be too high when the boosting power is increased to a maximum of 3 power.

FIG. 12 illustrates an embodiment of the boosting circuit 11, and Table 1 shows the relationship between the preset values of the boosting power selection register 33 and the VLOUT state of the boosting circuit 11. FIG. 13 the principle of operation of generating boosted voltages.

TABLE 1

| Setting of boosting power selection register | | Output level (VLOUT) of boosting |
|---|---|---|
| BT1 | BT0 | circuit 11 |
| 0 | 0 | Boosting operation is stopped. VLOUT of GND level is outputted. |
| 0 | 1 | 1 Power boosting operation. VLOUT of Vci level is outputted. |
| 1 | 0 | 2 Power boosting operation. VLOUT of 2 power boosted level is outputted. |
| 1 | 1 | 3 Power boosting operation. VLOUT of 3 power boosted level is outputted. |

As shown in Table 1, the boosting power selection register 33 has control bits BT1, BT0. When the bits BT1, BT0 are "00", the boosting circuit 11 ceases to operate, and the terminal VLOUT outputs a ground potential GND. When the control bits BT1, BT0 are "01", the boosting power of the boosting circuit 11 becomes one, and the terminal VLOUT outputs a basic voltage Vci. When the control bits BT1, BT0 are 10, the boosting power of the boosting circuit 11 becomes two, and the terminal VLOUT outputs a voltage 2 times the basic voltage Vci. When the control bits BT1, BT0 are "11", the boosting power of the boosting circuit 11 becomes three, and the terminal VLOUT outputs a voltage 3 times the basic voltage Vci.

Figure 12A:
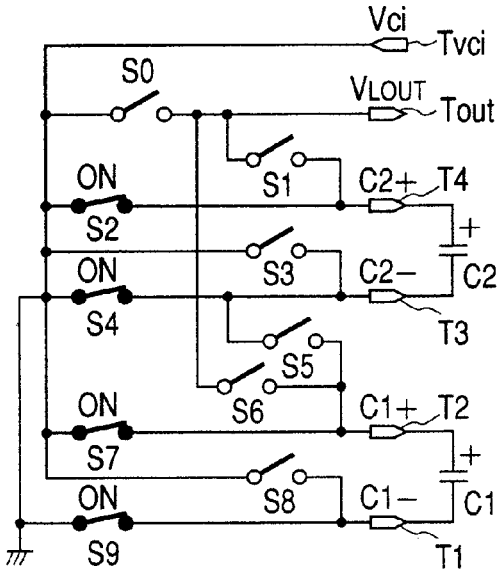
FIGS. 12(A), 12(B), 12(C) and 12(D) are circuit diagrams illustrating concrete examples of the boosting circuit 11 for generating the liquid crystal drive voltage.
Figure 12B:
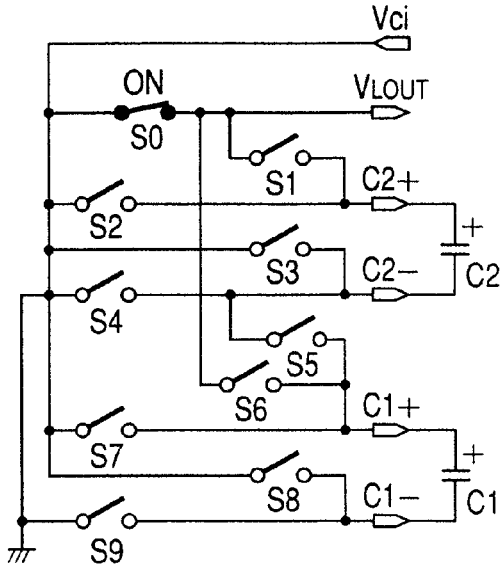

As shown in FIGS. 12(A), 12(B), 12(C) and 12(D), the boosting circuit 11 is constituted by a capacitor C1 connected between external terminals T1 and T2, a capacitor C2 connected between external terminals T3 and T4 and switches S0 to S9 connected among a voltage input terminal Tvci, a boosted voltage output terminal Tout, and external terminals T1 to T4. When the boosting circuit 11 is producing a 1 power boosted output voltage, the switch S0 only is turned on as shown in FIG. 12(B) and the input voltage Vci is directly output as an output voltage VLOUT from a terminal Tout.

Figure 12C:
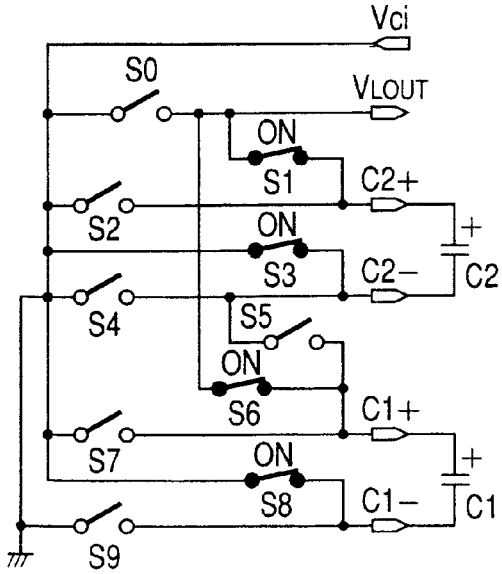
Figure 12D:
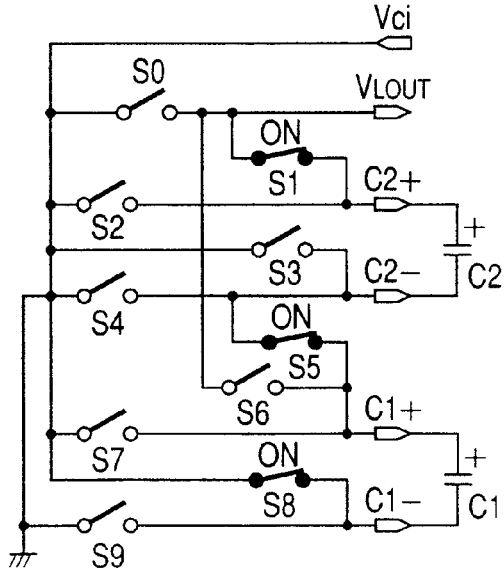
Figure 13A:
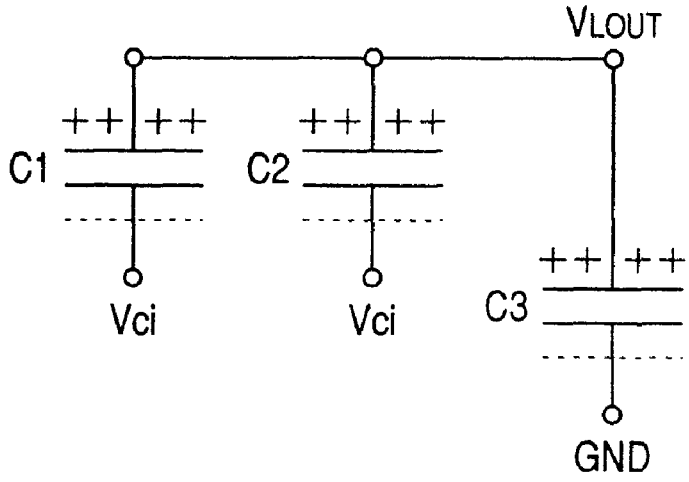
FIGS. 13(A) and 13(B) are diagrams illustrating the principle of the boosting operation of from 1 power to 3 power of the boosting circuit 11 for generating the liquid crystal drive voltage.
Figure 13B:
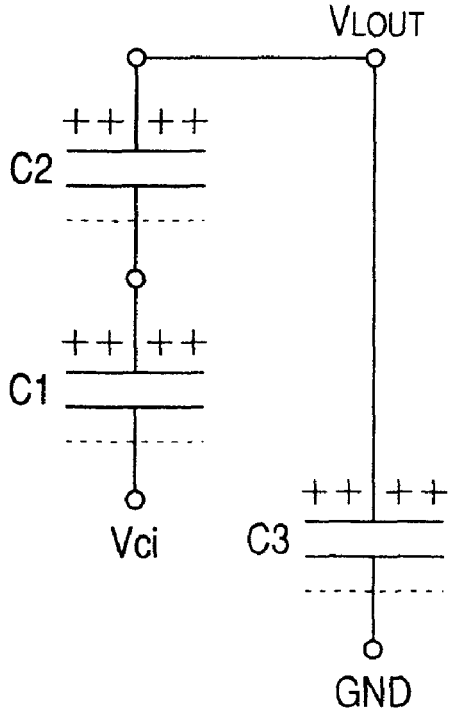

At the time of 2 power boosted voltage or 3 power boosted voltage as shown in FIG. 12(A), the switches S2, S4, S7 and S9 are, first, turned on, and the capacitors C1 and C2 are electrically charged to Vci. Next, at the time of 2 power boosted voltage as shown in FIG. 12(C), the switches S1, S3, S6 and S8 are turned on, thereby the two capacitors C1 and C2 are connected in parallel as shown in FIG. 13(A), the terminal to which the ground potential has been applied at the time of charging is connected to the voltage input terminal, Vci is applied to the terminal, and a voltage 2×Vci is output. At the time of 3 power boosted voltage as shown in FIG. 12(D), the switches 51, S5 and S8 are turned on, thereby the two capacitors C1 and C2 are connected in series as shown in FIG. 13(B), and the terminal to which the ground potential has been applied at the time of charging is connected to the voltage input terminal, and Vci is applied to the terminal, and a voltage 3×Vci is output.

As described above, the boosting power of the boosting circuit 11 is arbitrarily set. When the liquid crystal needs to be driven at a low voltage, therefore, the boosting power is lowered to a required minimum limit, decreasing the operating voltages of the drive bias circuit 18 and the power supply circuit 17 serving as a power supply circuit for driving the liquid crystal, and improving the efficiency of the boosting circuit 11. This makes it possible to greatly suppress the electric current consumed by the controller 2.

Next, below will be concretely described a method of setting the boosting power of the boosting circuit 11. Assuming that the liquid crystal drive voltage is, for example, 8 V when the display is produced on 4 rows by the 1/32 duty drive, the boosting circuit 11 must boost the voltage by three times when the system power supply voltage is 3 V. Therefore, the data for instructing 3 power boosting is set in the boosting power selection register 33 from the microprocessor 3. Even when the display needs be produced on 1 row only while the system is in the stand-by state, the liquid crystal drive voltage is boosted by three times, i.e., is 8 V if the 1/32 duty drive is maintained, and the electric current consumed by the controller 2 cannot be decreased. Therefore, the data for instructing the 1/8 duty drive is set in the drive duty selection register 34 by the microprocessor 3 to thereby change the duty ratio. Furthermore, the data for instructing 2 power boosting is set in the register 33 by the microprocessor 3, so that the liquid crystal drive voltage is set to be about 5 V. Thus, a sufficiently large liquid crystal drive voltage is obtained even when the operation of the boosting circuit 11 is changed to 2 power boosting by the boosting power selection register 33, making it possible to decrease the consumption of electric current, when viewed from the system power supply 40 of 3 V to about two-thirds.

To obtain a favorable contrast after the liquid crystal drive duty is changed, furthermore, it is desirable to optimize the drive bias ratio. In general, when the drive duty is 1/N, the optimum drive bias ratio B for obtaining an optimum contrast is, $B=1/(\sqrt{N}+1)$ For example, the optimum drive biases at 1/8 duty, 1/16 duty and 1/32 duty are 1/4 bias, 1/5 bias and 1/6.7 bias.

Figure 14A:
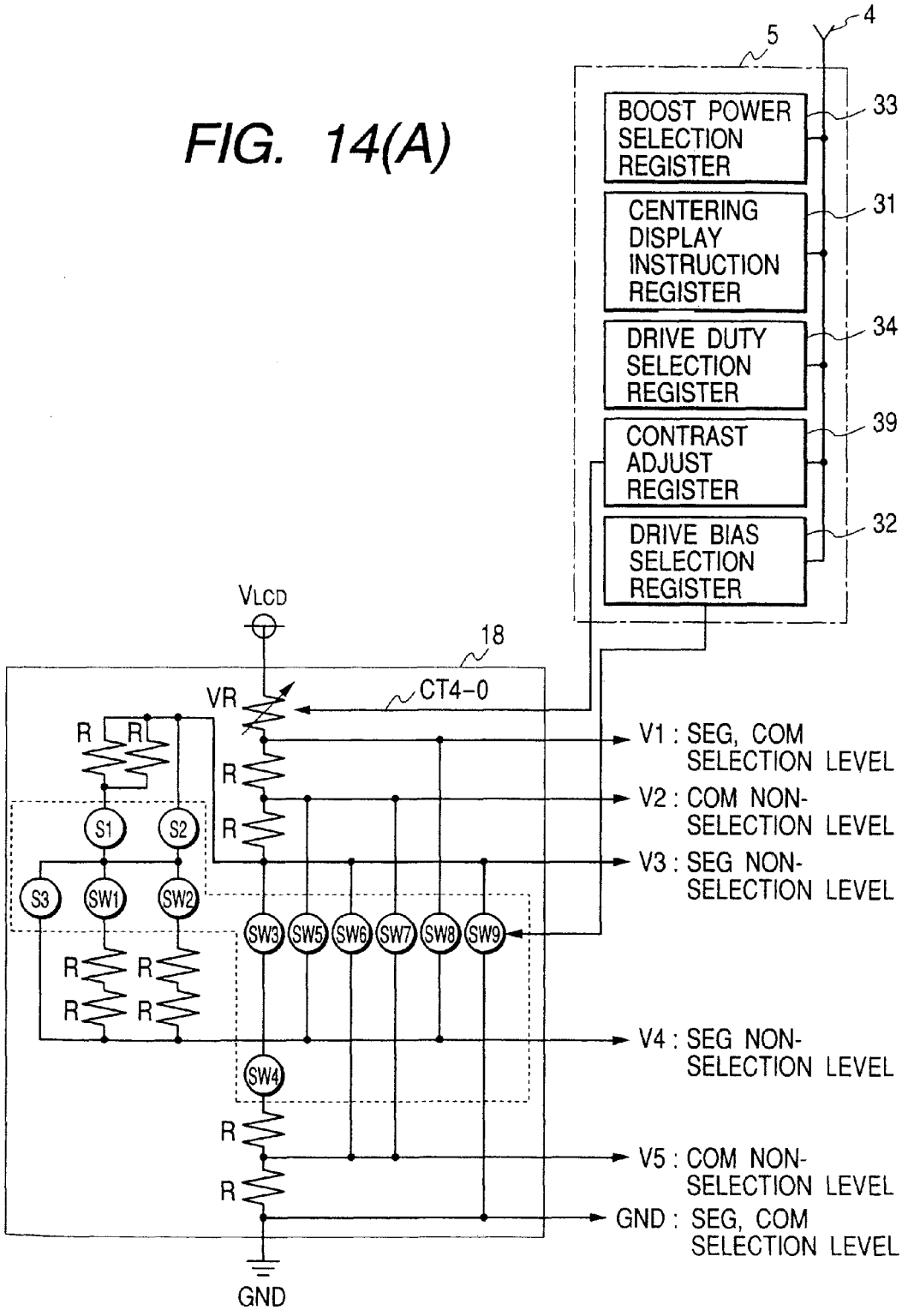
FIG. 14(A) is a diagram concretely illustrating the constitution of a circuit 18 for setting a bias for driving liquid crystal.

FIG. 14(A) illustrates the liquid crystal drive bias circuit 18 of the embodiment, and Table 2 shows the relationships between the set states of the liquid crystal bias selection register 32 in the bias modes and the on/off states of the switches SW1 to SW9, S1 to S3 in the liquid crystal drive bias circuit 18. Though there is no particular limitation, the liquid crystal bias selection register 32 is provided in the instruction register 5. In Table 2, "-" represents the off state. As the microprocessor 3 sets a drive bias in the liquid crystal bias selection register 32 in the instruction register 5, the liquid crystal display controller 2 of the embodiment arbitrarily changes the drive bias ratio in the liquid crystal drive bias circuit 18.

TABLE 2

| | | | | | | | | | |
|---|---|---|---|---|---|---|---|---|---|
| Drive bias selection register | BS1 | 0 | 0 | 0 | 0 | 1 | 1 | 1 | 1 |
| | BS2 | 0 | 0 | 1 | 1 | 0 | 0 | 1 | 1 |
| | BS3 | 0 | 1 | 0 | 1 | 0 | 1 | 0 | 1 |
| Liquid crystal drive bias | | 1/6.5 | 1/6 | 1/5.5 | 1/5 | 1/4.5 | 1/4 | 1/3 | 1/2 |
| Change over of switches | SW1 | ON | ON | ON | ON | — | — | — | — |
| | SW2 | — | — | ON | ON | — | — | — | — |
| | SW3 | — | — | — | | — | ON | — | — |
| | SW4 | ON | ON | ON | ON | ON | ON | ON | — |
| | SW5 | — | — | — | — | — | — | ON | — |

TABLE 2-continued

| | | | | | | | | |
|---|---|---|---|---|---|---|---|---|
| SW6 | — | — | — | — | — | — | ON | — |
| SW7 | — | — | — | — | — | — | — | ON |
| SW8 | — | — | — | — | — | — | — | ON |
| SW9 | — | — | — | — | — | — | — | ON |
| S1 | ON | — | ON | — | ON | — | — | — |
| S2 | — | ON | — | ON | — | — | — | — |
| S3 | — | — | — | — | ON | — | — | — |

Figure 14B:
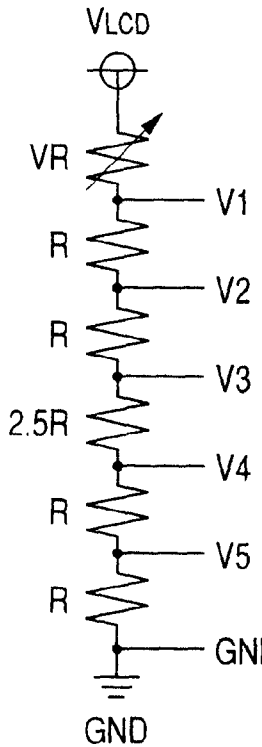
FIGS. 14(B), 14(C), 14(D), 14(E), 14(F), 14(G), 14(H) and 14(I) are diagrams of equivalent circuits for setting biases.
Figure 14C:
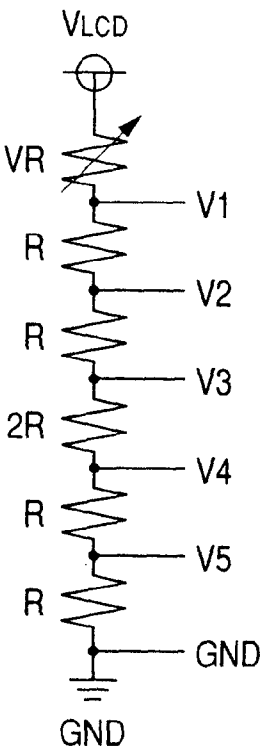
Figure 14D:
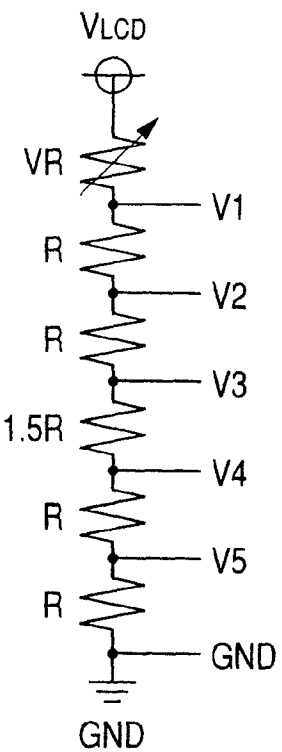
Figure 14E:
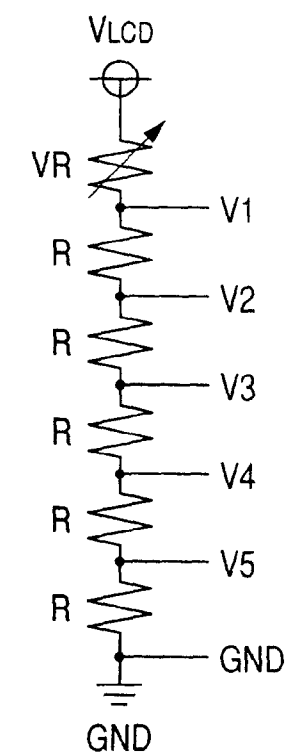
Figure 14F:
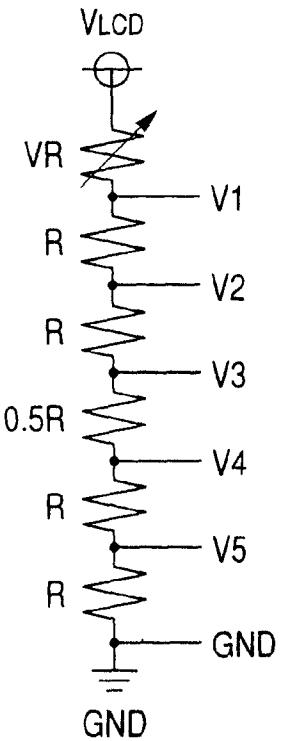
Figure 14G:
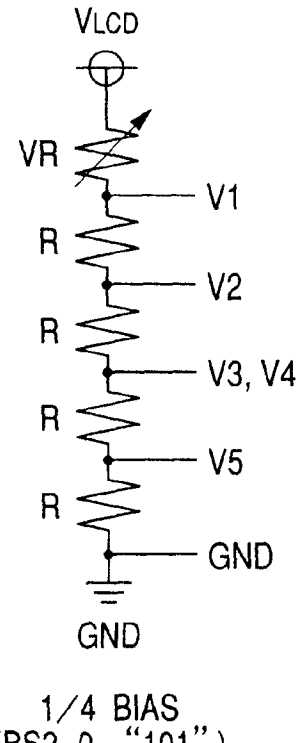
Figure 14H:
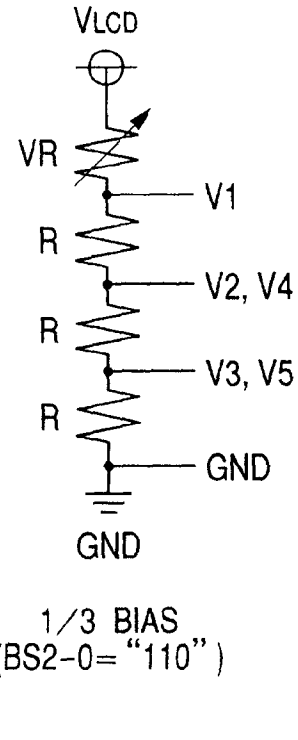
Figure 14I:
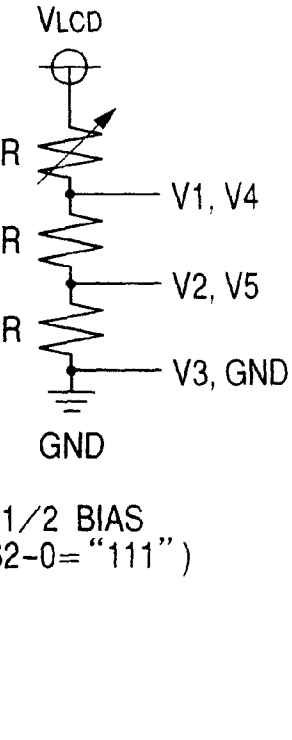

As shown in Table 2, the drive bias selection register 32 includes control bits BS2, BS1 and BS0. When the control bits BS2, BS1 and BS0 are set at "000", the liquid crystal drive bias becomes 1/6.5 bias, whereby the switches SW1, SW4 and S1 are turned on and an equivalent circuit shown in FIG. 14(B) is formed. When the control bits BS2, BS1 and BS0 are set at "001", the liquid crystal drive bias becomes 1/6 bias, whereby the switches SW1, SW4 and S2 are turned on and an equivalent circuit shown in FIG. 14(C) is formed. When the control bits BS2, BS1 an BS0 are set at "010", the liquid crystal drive bias becomes 1/5.5 bias, whereby the switches SW1, SW2, SW4 and S1 are turned on and an equivalent circuit shown in FIG. 14(D) is formed. When the control bits BS2, BS1 and BS1 are set at "011", the liquid crystal drive bias becomes 1/5 bias, whereby the switches SW1, SW2, SW4 and S2 are turned on and an equivalent circuit shown in FIG. 14(E) is formed. When the control bits BS2, BS1 and BS0 are set at "100", the liquid crystal drive bias becomes 1/4.5 bias, whereby the switches SW4, S1 and S3 are turned on and an equivalent circuit shown in FIG. 14(F) is formed. When the control bits BS2, BS1 and BS0 are set at "101", the liquid crystal drive bias becomes 1/4 bias, whereby the switches SW3 and SW4 are turned on and an equivalent circuit shown in FIG. 14(G) is formed. When the control bits BS2, BS1 and BS0 are set at "110", the liquid crystal drive bias becomes 1/3 bias, whereby the switches SW4, SW5 and SW6 are turned on and an equivalent circuit shown in FIG. 14(H) is formed. When the control bits BS2, BS1 and BS0 are set at "111", the liquid crystal drive bias becomes 1/2 bias, whereby the switches SW7, SW8, and SW9 are turned on and an equivalent circuit shown in FIG. 14(H) is formed. Symbol R denotes a reference resistor.

In FIG. 14(A), the first voltage V1 and the ground potential GND take a selection level of the segment electrodes SEG1-80 and the common electrodes COM1-32, the second voltage V2 and the fifth voltage V2 take a non-selection level of the common electrodes COM1-32, and the third voltage V3 and the fourth voltage V4 take a non-selection level of the segment electrodes SEG1-80. As described above, the reason why there are two non-selection levels is that V2 and V3 or V5 and V4 (AC bias) are applied to the common electrodes COM1-32 corresponding to turned-off (white) dots and to the segment electrodes SEG1-80, in order to prevent the liquid crystal from being deteriorated. The AC drive will be described later with reference to FIGS. 14(K) and 14(L).

In FIG. 14(A), symbol VR denotes a variable resistor for adjusting the contrast. As shown, the instruction register 5 includes the contrast adjust register 39 that sets the amount of adjusting resistance of the variable resistor VR. The resistance of the variable resistor VR is changed depending upon the value set in the resistor thereby to adjust the contrast of the liquid crystal display panel.

FIG. 14(J) shows preset values of five control bits CT4 to CT0 of the contrast adjust register 39 and values of the variable resistor VR. Reference numeral R denotes a reference resistor. As will be understood from FIG. 14(J), the value of the variable resistor VR decreases from 3.2×R down to 0.1×R in units of 0.1 as the control bits CT4 to CT0 successively change from "00000" to "11111". Thus, the potential difference between V1 and GND, i.e., the liquid crystal drive voltage is finely adjusted to adjust the contrast.

Next, the AC drive will be described with reference to FIGS. 14(K) and 14(L). First, FIG. 14(L) will be explained. FIG. 14(L) is a plan view schematically illustrating, on an enlarged scale, a portion of the dot-matrix liquid crystal panel 1, and illustrating transparent common electrodes ECOM1 to ECOM3 arranged in the direction of row to which common signals COM1 to COM3 are applied, respectively, and transparent segment electrodes ESEG1 to ESEG3 arranged in a direction (of column) perpendicular to the transparent electrodes ECOM1 to ECOM3 segment signals SEG1 to SEG3 are supplied to the transparent segment electrodes ESEG1 to ESEG3. A liquid crystal layer (mentioned later) is provided between the transparent segment electrodes ESEG1 to ESEG3 and the transparent common electrodes ECOM1 to ECOM3, and each intersecting portion corresponds to one dot of the dot-matrix. In FIGS. 5(*a*) to 5(*c*) and FIGS. 8(*a*) to 8(*c*), each of the square frames (turned off) and black squares (turned on) forms one dot. In FIG. 14(L), the dot at the intersecting point of the transparent electrode ECOM1 and the transparent electrode ESEG1 is turned on, and the dot at the intersecting point of the transparent electrode ECOM2 and the transparent electrode ESEG2 is turned on, but the other dots are all turned off.

Figure 14K:
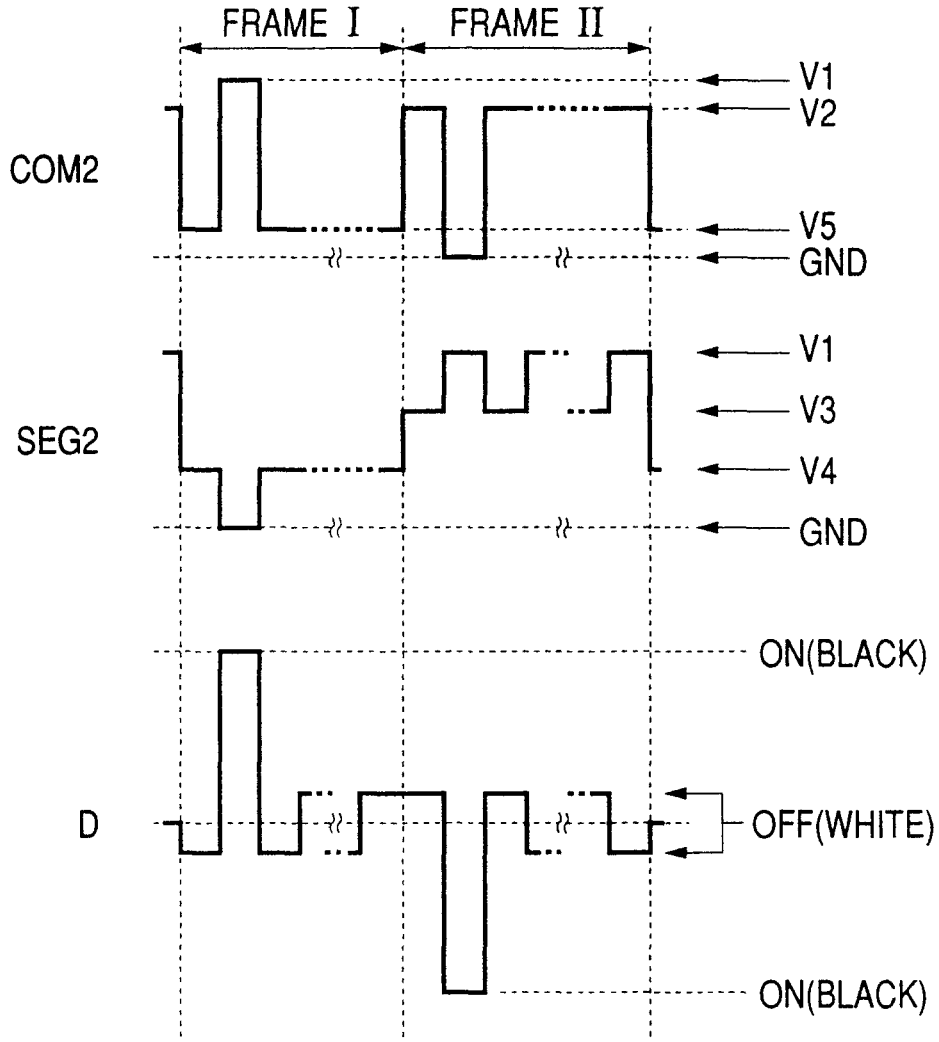
FIG. 14(K) is a diagram of waveforms of a common signal and a segment signal in the frames I and II in the AC drive system.
Figure 14L:
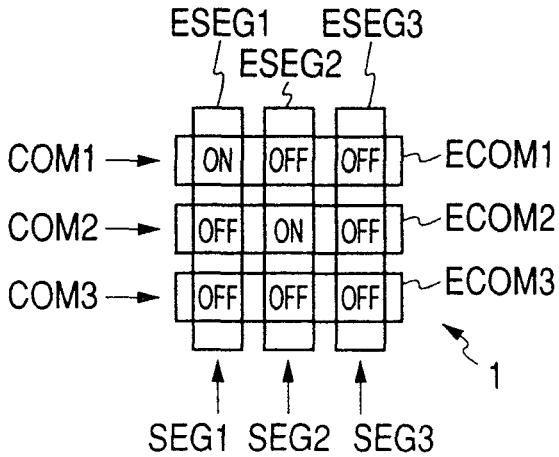
FIG. 14(L) is a diagram in plan view of a portion of the dot-matrix liquid crystal display panel.

FIG. 14(K) shows the dot at the intersecting point of the transparent electrode ECOM2 and the transparent electrode ESEG2 of FIG. 14(L), i.e., shows a common signal COM2 of the dot that is turned on, a segment signal SEG2, and a pixel signal D in a first frame (frame I) and a second frame (frame II).

In the first frame (frame I), the selection level of the common signal COM2 is V1 and the non-selection level is V5. In the first frame (frame I), the selection level of the segment signal SEG2 is GND and the non-selection level is V4. Any dot turns on when the voltage obtained by subtracting the potential of the segment signal from the potential of the common signal, exceeds the threshold value of the liquid crystal. The difference in the potential is used as a pixel signal D. Therefore, the dot at the intersecting point of the transparent electrode ECOM2 and the transparent electrode ESEG2 is turned on. In the second frame (frame II), the selection level of the common signal COM2 is GND and the non-selection level is V2. In the first frame (frame I), the selection level of the segment signal SEG2 is V1 and the non-selection level is V3. Therefore, the dot at the intersecting point of the transparent electrode ECOM2 and the transparent electrode ESEG2 turns on. Thus, the polarities of selection level and non-selection level are inverted between the first frame (frame I) and the second frame (frame II). Such a drive method is called AC drive (AC bias), and the liquid crystal is effectively prevented from being deteriorated.

Figure 15A:
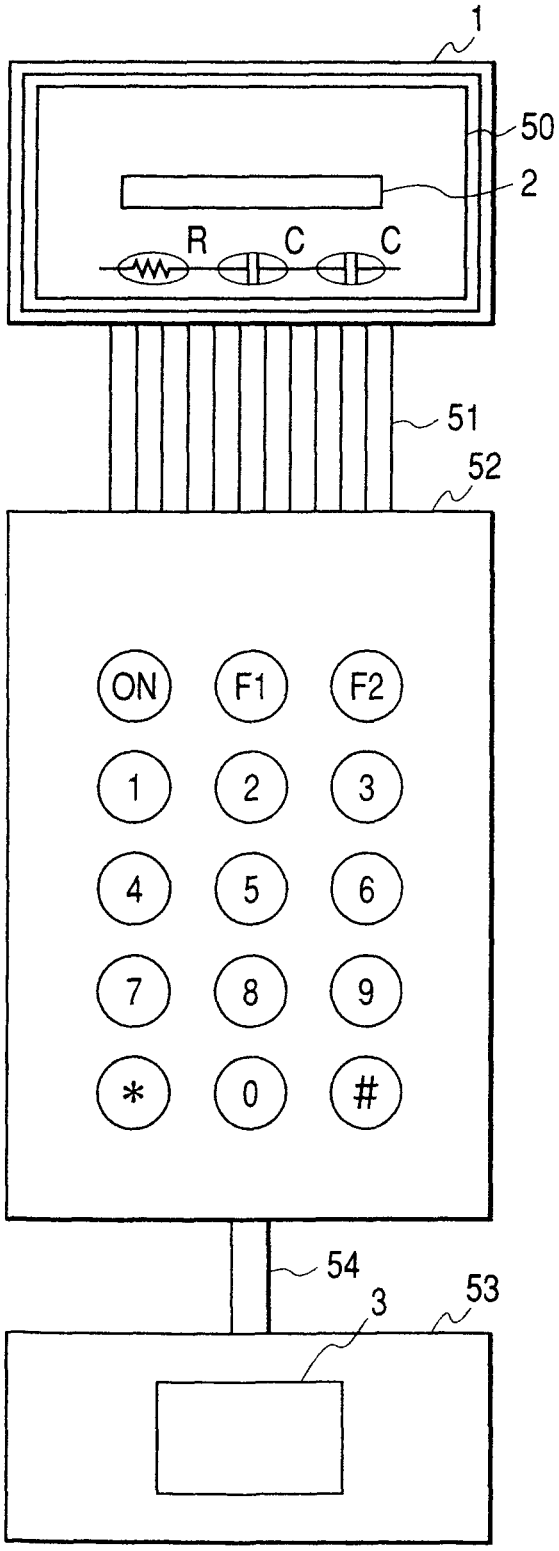
FIGS. 15(A), 15(B), 15(C) and 15(D) are diagrams schematically illustrating examples where the liquid crystal display controller of the embodiment is mounted on a portable telephone set together with the liquid crystal display panel.

FIGS. 15(A) to 15(D) illustrate examples where the liquid crystal display controller 2 of the above-mentioned embodiment is mounted in a portable telephone set together with the liquid crystal display panel. Among them, FIG. 15(A) illustrates an example where a substrate 50 on which are mounted a liquid crystal display controller chip 2 of the embodiment constituted in the form of a semiconductor integrated circuit and additional capacitors C and resistors R, are joined to the back of a glass substrate that constitutes a liquid crystal display panel 1, and a key matrix substrate 52 constituting an operation panel is connected to the substrate 50 through a wiring 51 called a heat seal. Reference numeral 53 denotes an MPU substrate mounted with the microprocessor chip 3. Though there is no particular limitation, the MPU substrate 53 and the key matrix substrate 52 are connected together through a serial communication line 54.

Figure 15B:
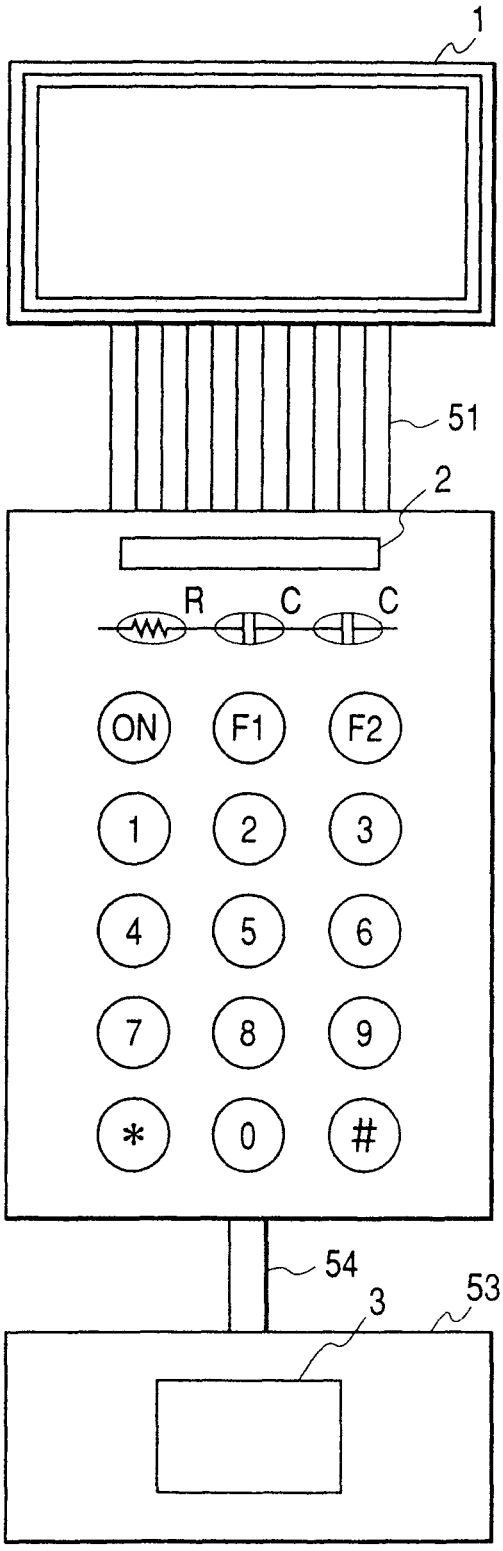

FIG. 15(B) illustrates an example where the liquid crystal display controller chip 2 and the additional capacitors C and resistors R are mounted on the key matrix substrate 52 constituting the operation panel of the portable telephone set, and the liquid crystal display panel 1 is connected to the key matrix substrate 52 through the heat seal 51.

Figure 15C:
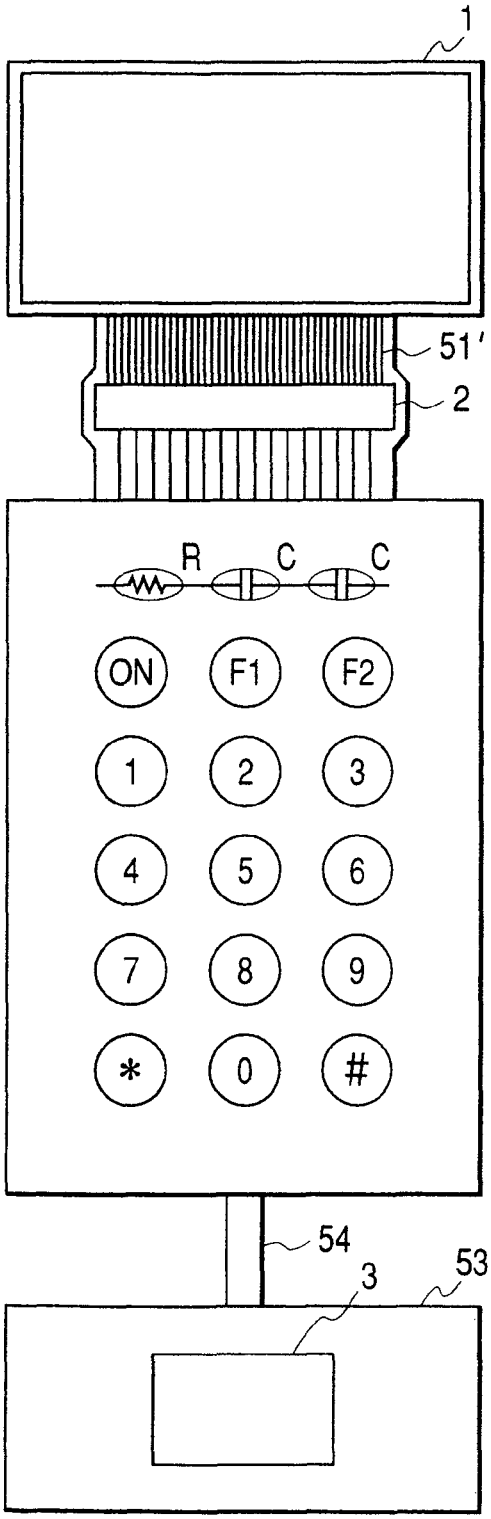

FIG. 15(C) illustrates an example where the additional capacitors C and resistors R are mounted on the key matrix substrate 52 constituting the operation panel, and the key matrix substrate 52 and the liquid crystal display panel 1 are connected together through a TCP (tape carrier package) 51' mounted with the liquid crystal display controller chip 2.

Figure 15D:
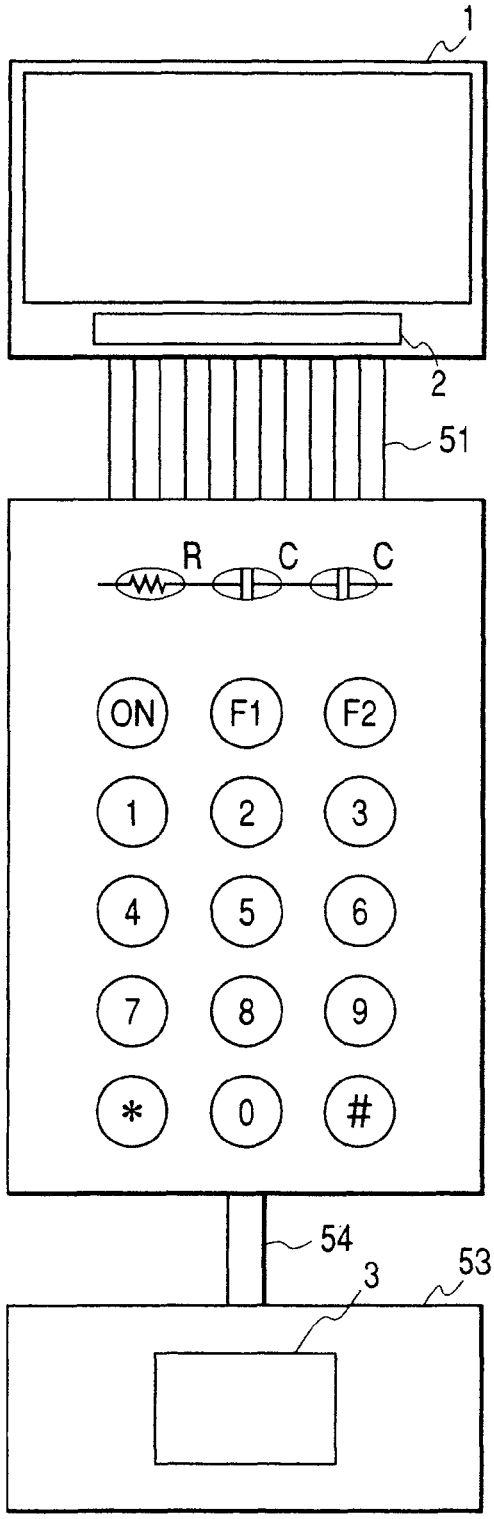

FIG. 15(D) illustrates an example where the additional capacitors C and resistors R are mounted on the key matrix substrate 52 constituting the operation panel, the liquid crystal display controller chip 2 is mounted on the glass substrate constituting the liquid crystal display panel 1, and the liquid crystal display panel 1 and the key matrix substrate 52 are connected together through the heat seal 51.

Figure 16A:
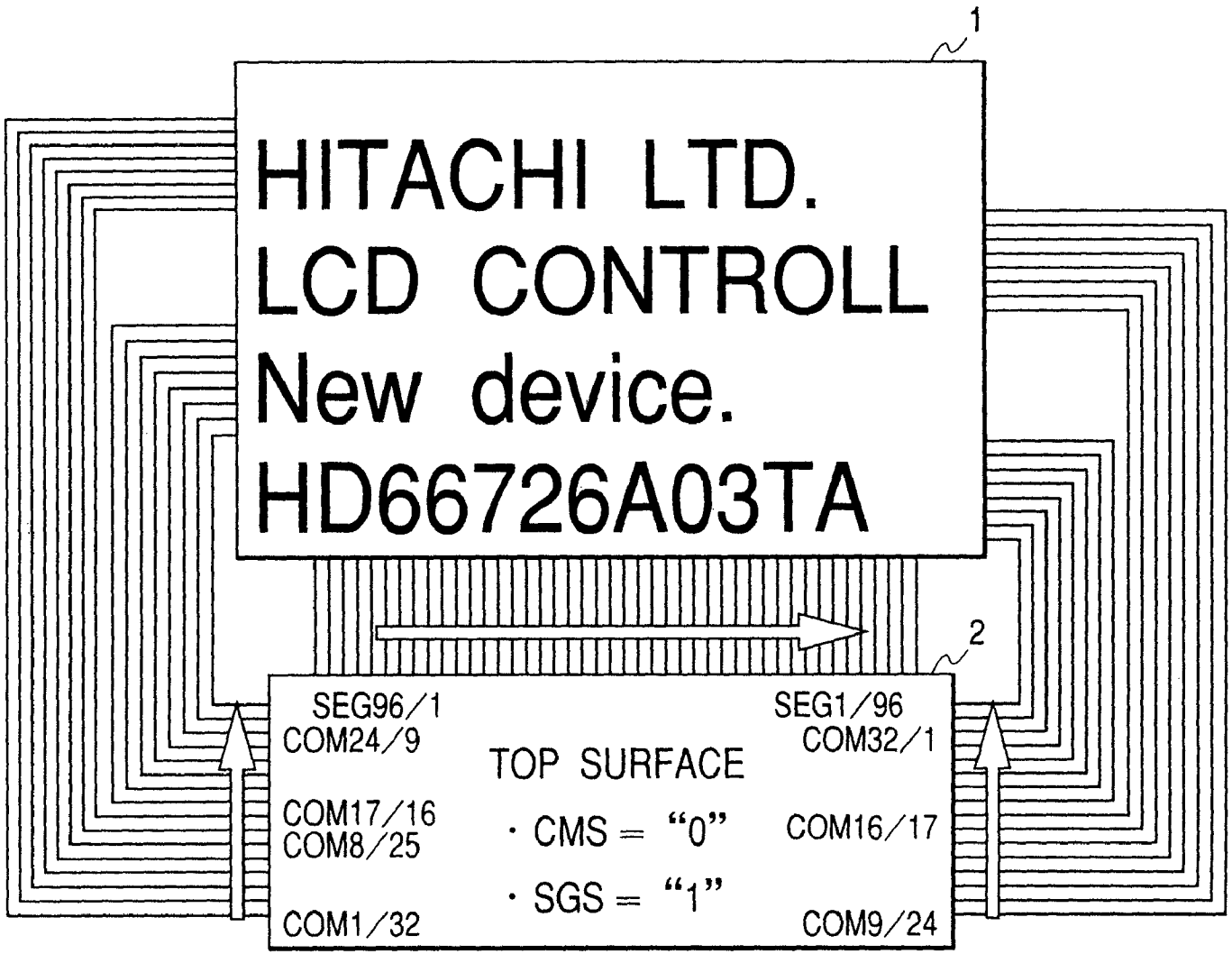
FIGS. 16(A) and 16(B) are diagrams schematically illustrating the arrangement of terminals of the liquid crystal display controller of the embodiment and an example of the connection between the liquid crystal display panel and the liquid crystal display controller.
Figure 16B:
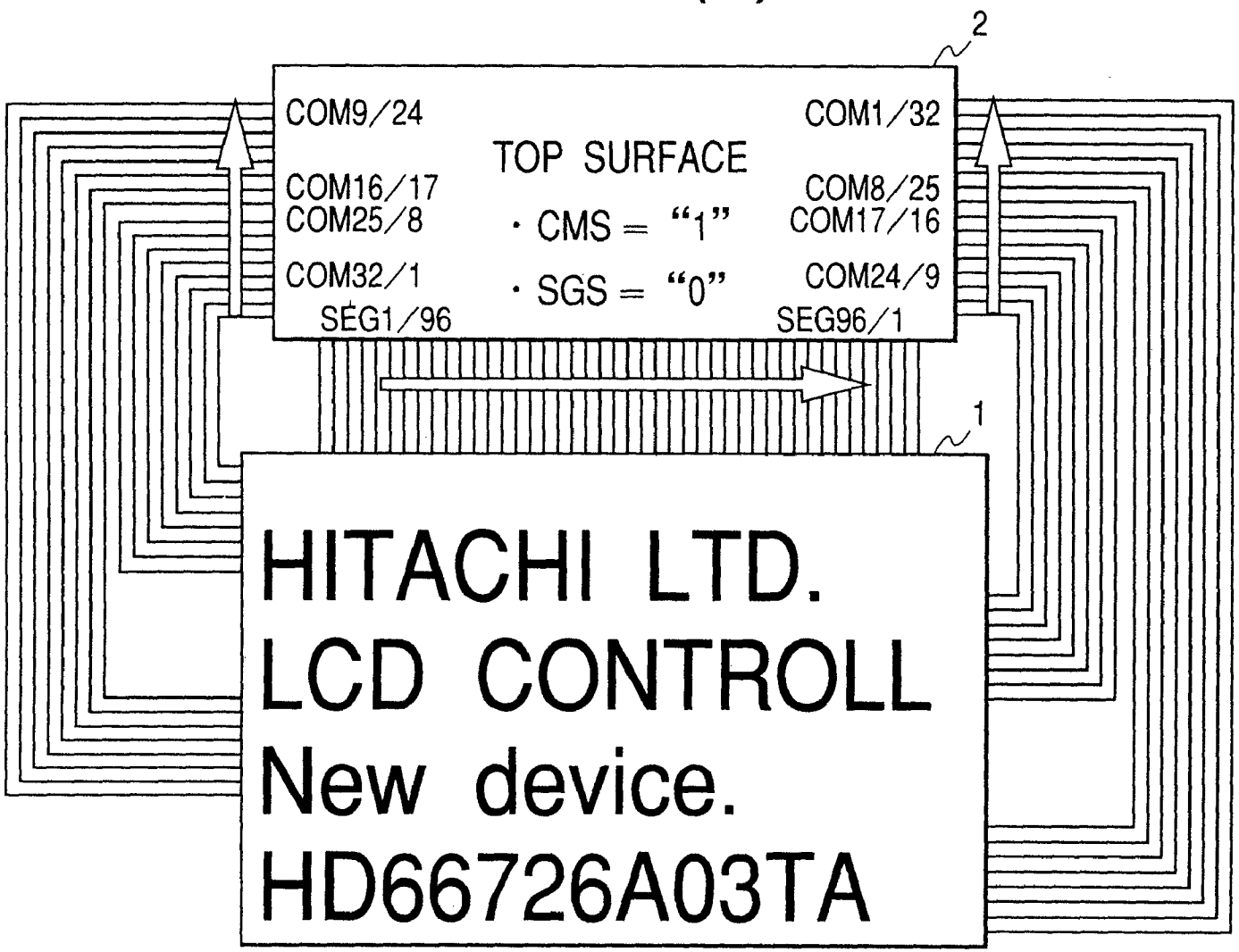

FIG. 16 illustrates the arrangement of terminals of the liquid crystal display controller 2 and the connection of the liquid crystal display panel 1 and the liquid crystal display controller 2. As shown in FIG. 16, the liquid crystal display controller 2 of this embodiment has terminals for outputting common signals COM1 to COM32 that are divided into halves which are arranged on the right and left short sides of the chip, and has terminals for outputting segment signals arranged along a long side thereof. Along the other long side are provided power supply terminals, additional terminals, and input/output terminals for transferring signals to/from the microprocessor. Since the terminals are arranged as described above, and the segment shift register 12 and the common shift register 15 are constituted by bidirectional shift registers, the common signal lines and the segment signal lines can be connected together without crossing the lines even when the liquid crystal display controller chip 2 is disposed at the upper or lower side of the liquid crystal display panel 1, or even when the liquid crystal display controller chip 2 is disposed upside down.

Figure 17:
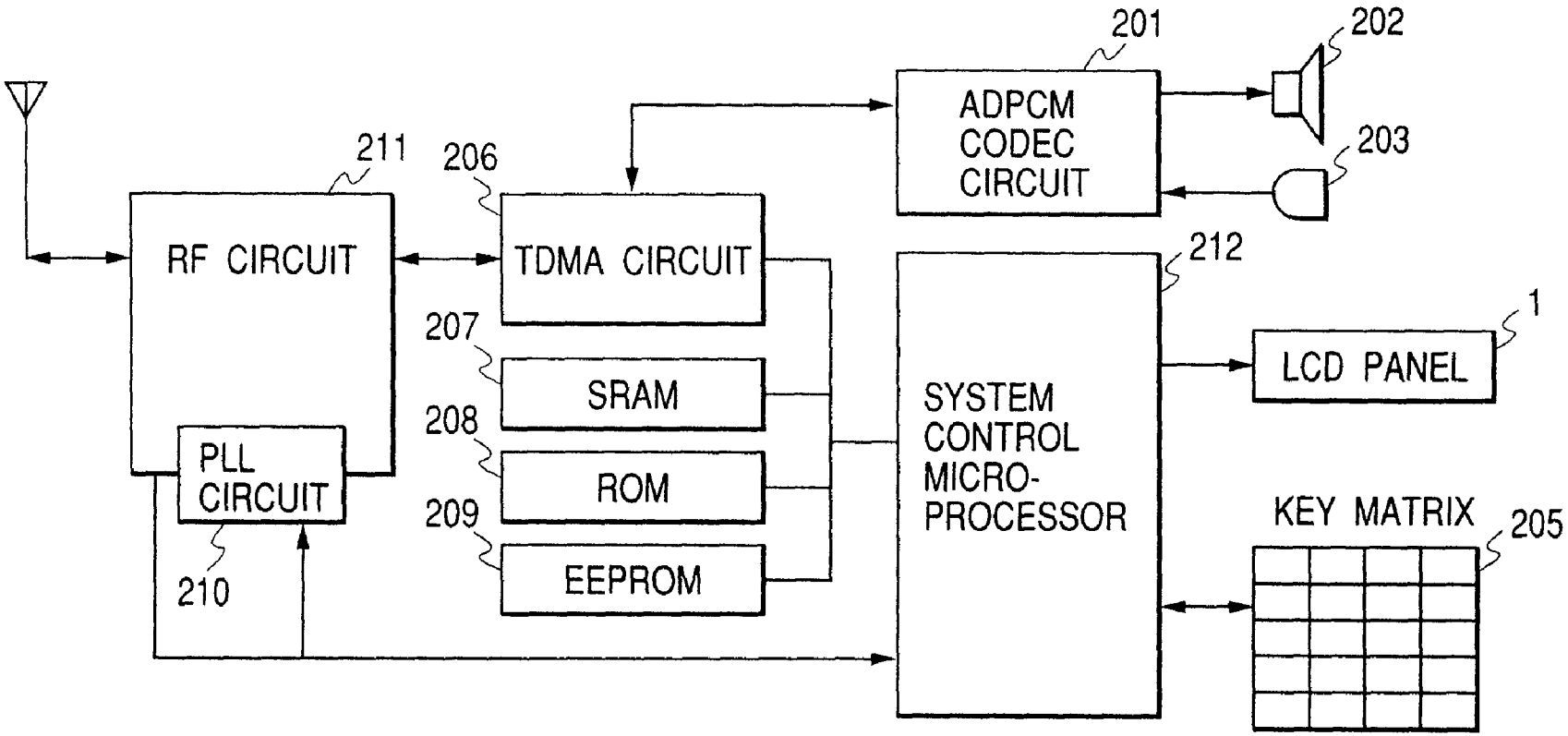
FIG. 17 is a block diagram schematically illustrating a portable telephone system to which a liquid crystal display system 100 of the invention is adapted.

FIG. 17 is a block diagram schematically illustrating the constitution of a portable telephone system by utilizing the liquid crystal display controller 2 of the present invention.

The portable telephone system shown in FIG. 17 is constituted by an ADPC code circuit 201, a loudspeaker circuit 202, a microphone circuit 202, a liquid crystal panel 1, a keyboard 205, a TDMA circuit 206 for multiplexing digital data in a time-division manner, memories such as an EEPROM 209 for storing the registered ID number, a ROM 208 for storing a program and an SRAM 207, a PLL circuit 210 for setting the carrier frequency of radio signal, an RF circuit 211 for transmitting and receiving radio signals, and a system control microcomputer 212 for controlling them.

Figure 18:
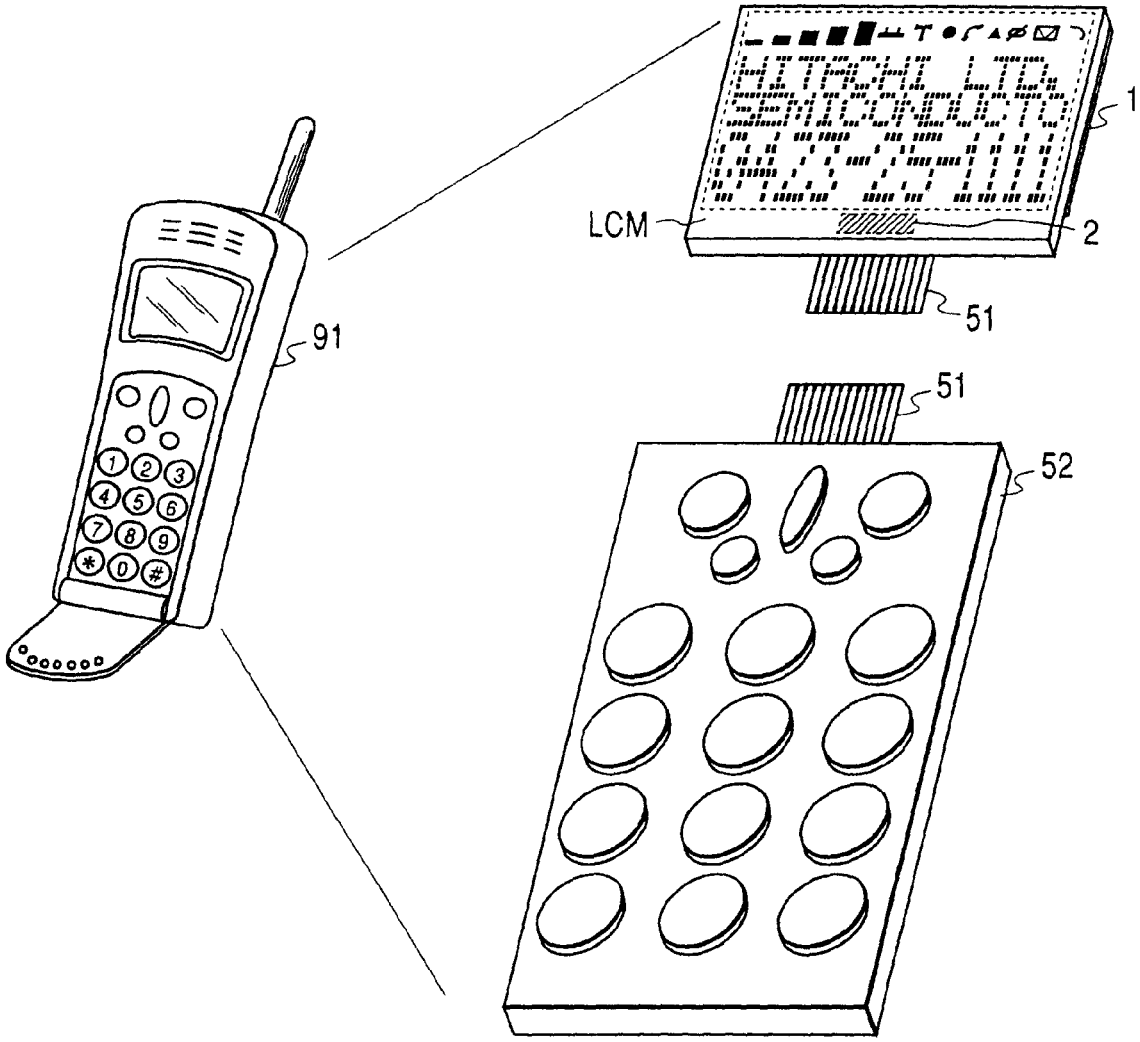
FIG. 18 is a diagram illustrating a portable telephone 91 to which the liquid crystal display system 100 of the invention is adapted.

FIG. 18 is a diagram illustrating a portable telephone set by utilizing the liquid crystal display controller 2 of the present invention. The liquid crystal display controller 2 of the present invention is mounted in a portable telephone set 91 in the form shown in FIG. 15(D).

Figure 19:
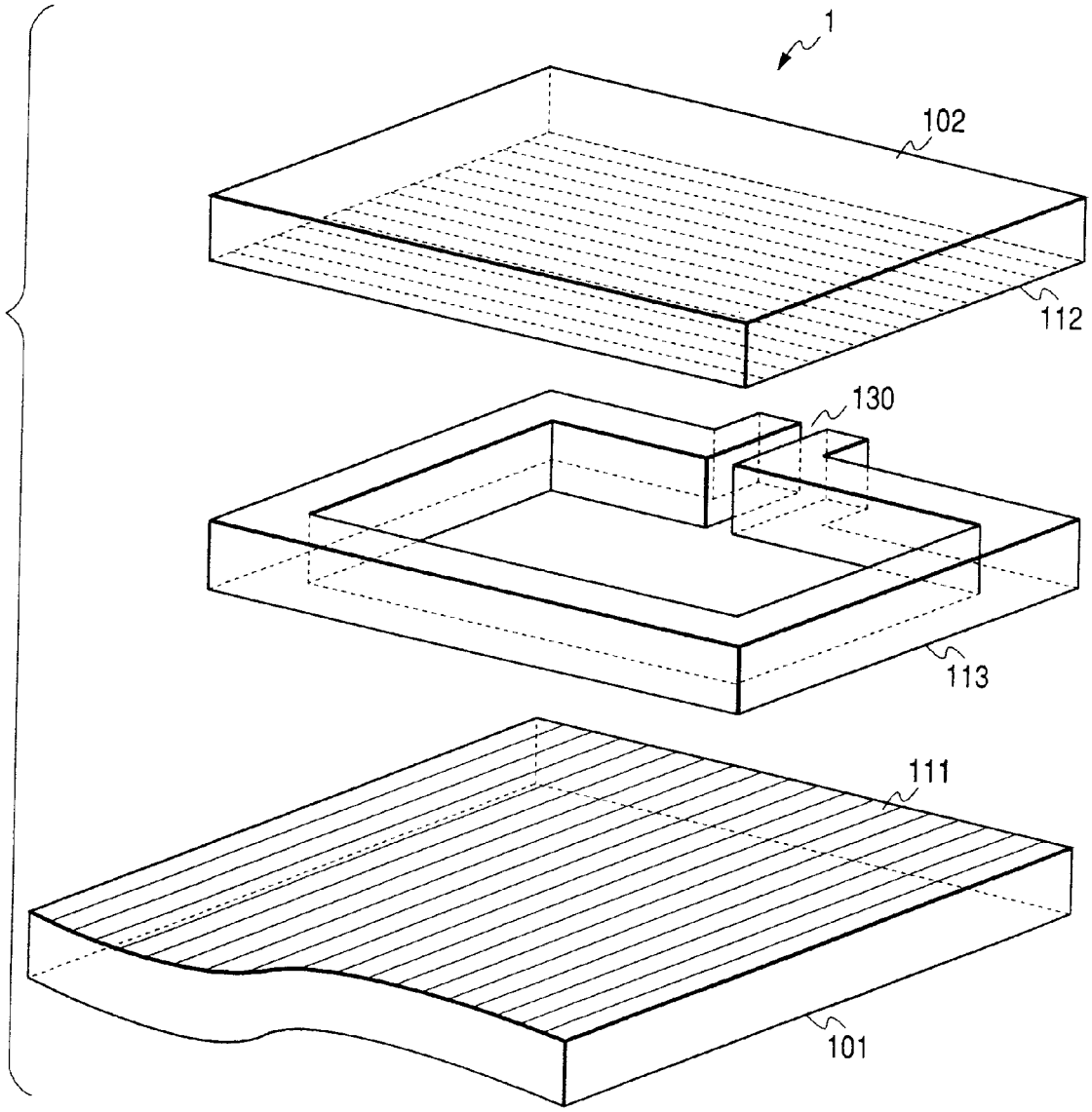
FIGS. 19 and 20 are diagrams illustrating the structure of a liquid crystal panel 1.
Figure 20:
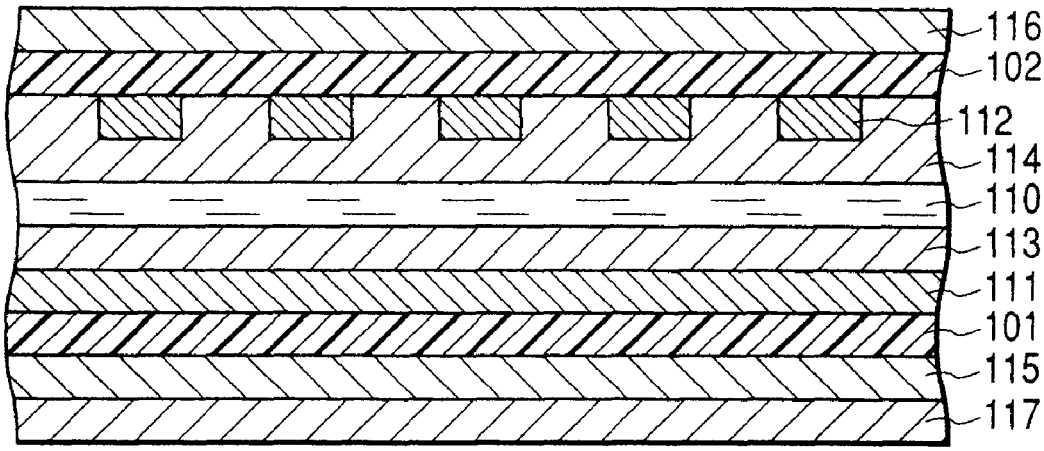

FIG. 19 is a perspective view schematically illustrating the constitution of the liquid crystal display panel 1 of FIG. 1, and FIG. 20 is a sectional view schematically illustrating the constitution of essential portions of the liquid crystal display panel 1 of FIG. 1.

The liquid crystal display panel 1 shown in FIGS. 19 and 20 is the one using, for example, STN (super-twisted nematic) liquid crystal. The liquid crystal display panel 1 has glass substrates 101 and 102 joined to each other via a sealing member 113, and a liquid crystal layer 110 sealed between the glass substrates 101, 102 and the sealing member 113. Liquid crystal are fed through an opening 130. As shown in FIGS. 19 and 20, a plurality of segment electrodes (ESEG) 111 of belt-like transparent electrically conductive film (indium-thin-oxide: ITO) are formed on the glass substrate side 101, and a plurality of common electrodes (ECOM) 112 of belt-like transparent electrically conductive film (ITO) are formed on the glass substrate side 102, with the liquid crystal layer 110 as the reference. On the inner side (liquid crystal layer side) of the glass substrate 101 are successively formed a plurality of segment electrodes 111 and an alignment layer 113, and on the inner side (liquid crystal layer side) of the glass substrate 102 are successively formed a plurality of common electrodes 112 and an alignment layer 114. On the outer side of the glass substrate 101 are formed a polarizer 115 and-a phase difference plate 117, and on the outer side of the glass substrate 102 is formed a polarizer 116 The segment electrodes 111 and the common electrodes 112 intersect each other, and intersecting portions of the segment electrodes 111 and common electrodes 112 form pixel regions (dots). A spacer can be arranged in the liquid crystal layer 110 to maintain constant the gap length of the liquid crystal layer 110.

Figure 21:
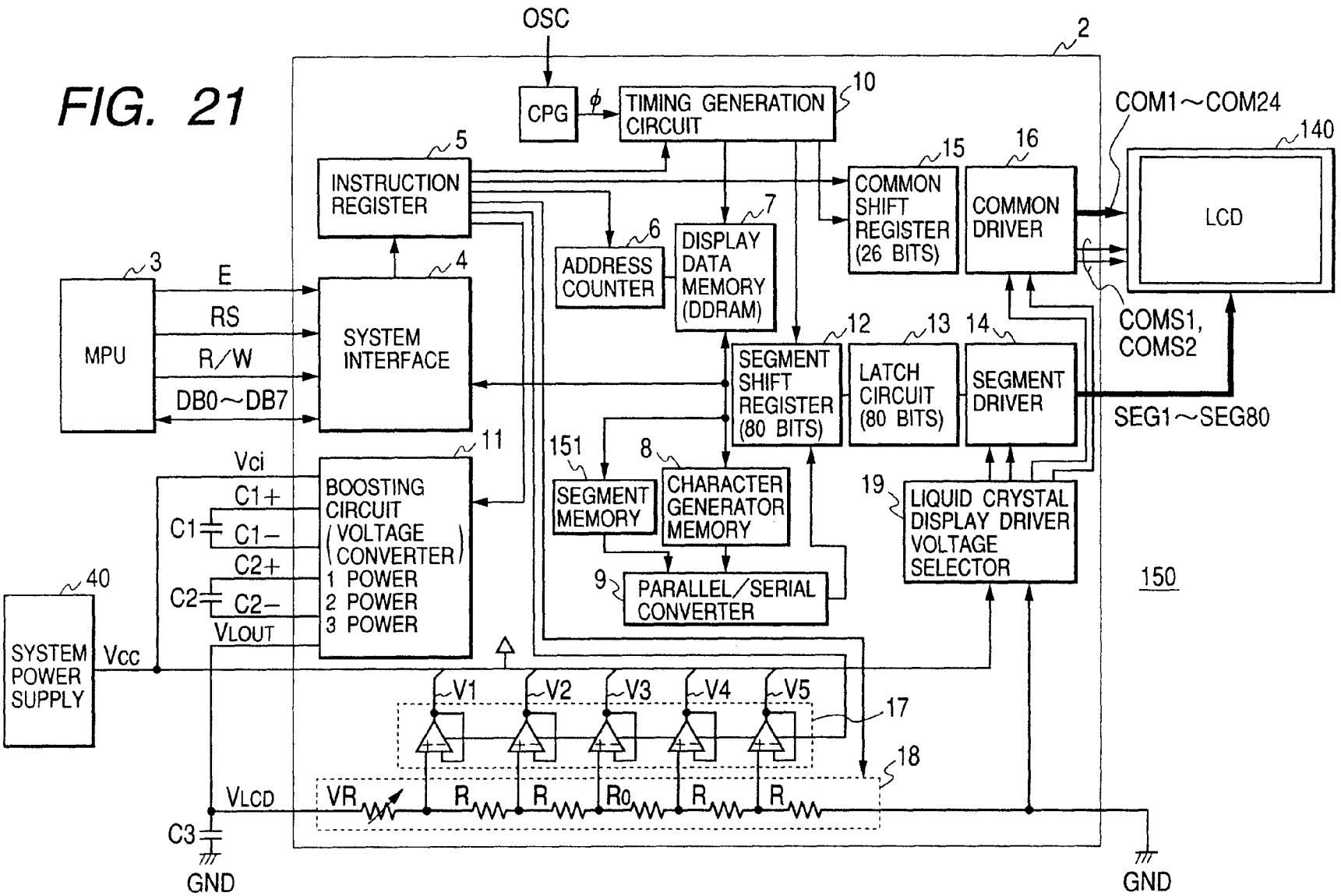
FIG. 21 is a block diagram of a liquid crystal display system 150 of another embodiment according to the present invention.

FIG. 21 illustrates a liquid crystal display system 150 of another embodiment according to the present invention. The liquid crystal display system 150 shown in FIG. 21 is different from the liquid crystal display system 100 shown in FIG. 1 in the below-mentioned points. The portions which are not particularly described are the same as those of the above-mentioned embodiment, and will not be described here again.

Figure 24:
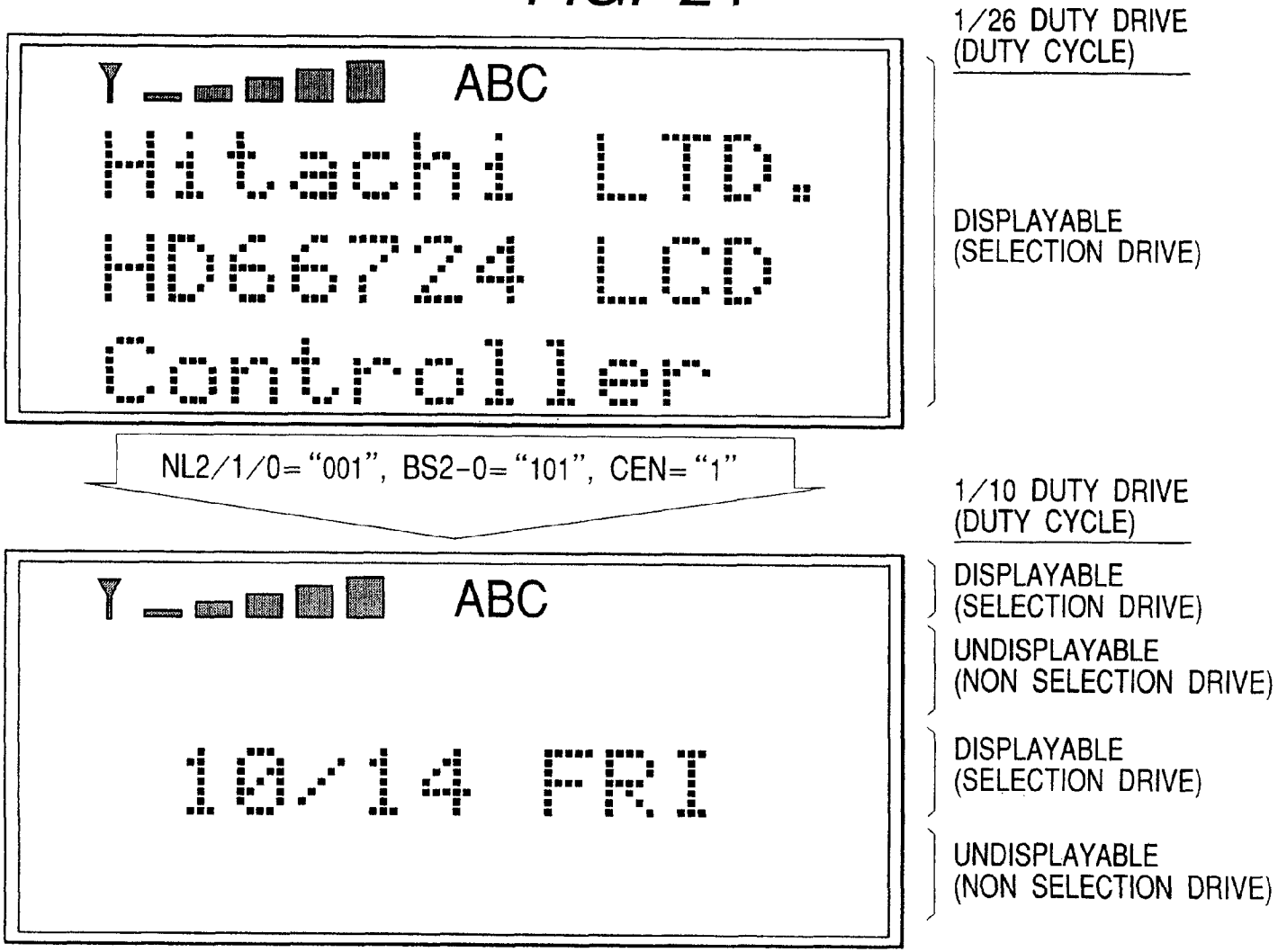
FIG. 24 is a diagram of display on a liquid crystal panel 140 that is shifted to the state of central display of the embodiment of FIG. 21.

The liquid crystal display controller 2 of this embodiment is suited for driving a liquid crystal panel 140 that is capable of displaying both segments such as marks, icons, patterns and numerals, and dot matrices such as characters and numerals as shown in FIG. 24. For this purpose, the liquid crystal display controller 2 includes a segment memory 151. The segment memory 151 stores segment display data supplied from the microprocessor 3 through a system interface 4. The segment memory has a storage capacity of, for example, 24 bytes, and is capable of displaying a maximum of 144 segments. The output of the segment memory 151 is connected to the parallel/serial converter 9, subjected to the parallel/serial conversion together with the output of the character generation memory 8, and is supplied to the segment shift register 12.

The common driver 15, too, is changed for the liquid crystal display controller 2 shown in FIG. 1. The common driver 15 is capable of displaying 3 rows of character font pattern constituted by 5×8 dots in the vertical direction, and is further capable of displaying, at the same time, 2 lines of segments. To display segments, therefore, the common driver 15 has a total of 24 output circuits for displaying dot matrices and 2 output circuits for displaying segments. That is, as shown in FIG. 21, the common driver 15 has common drive signals COM1 to COM24 for displaying dot matrices on the liquid crystal display panel 1, and common drive signals COMS1, COM2 for displaying segments. For producing a display on the whole surface of a liquid crystal panel 140, the signals COMS1, COM1 to COM24, COMS2 are successively caused to take the selection voltage level in a time-division manner. In this case, COM1 to COM8 are for the first row, COM9 to COM16 are for the second row, and COM17 to COM24 are for the third row. Each of the segment common drive signals COMS1, COMS2 is provided on the upper side or on the lower side of the liquid crystal panel 140. Depending upon the liquid crystal panel, however, only one of them is provided on the upper side or on the lower side. In such a case, one of the two segment common drive signals COMS1, COMS2 is not used.

Figure 22:
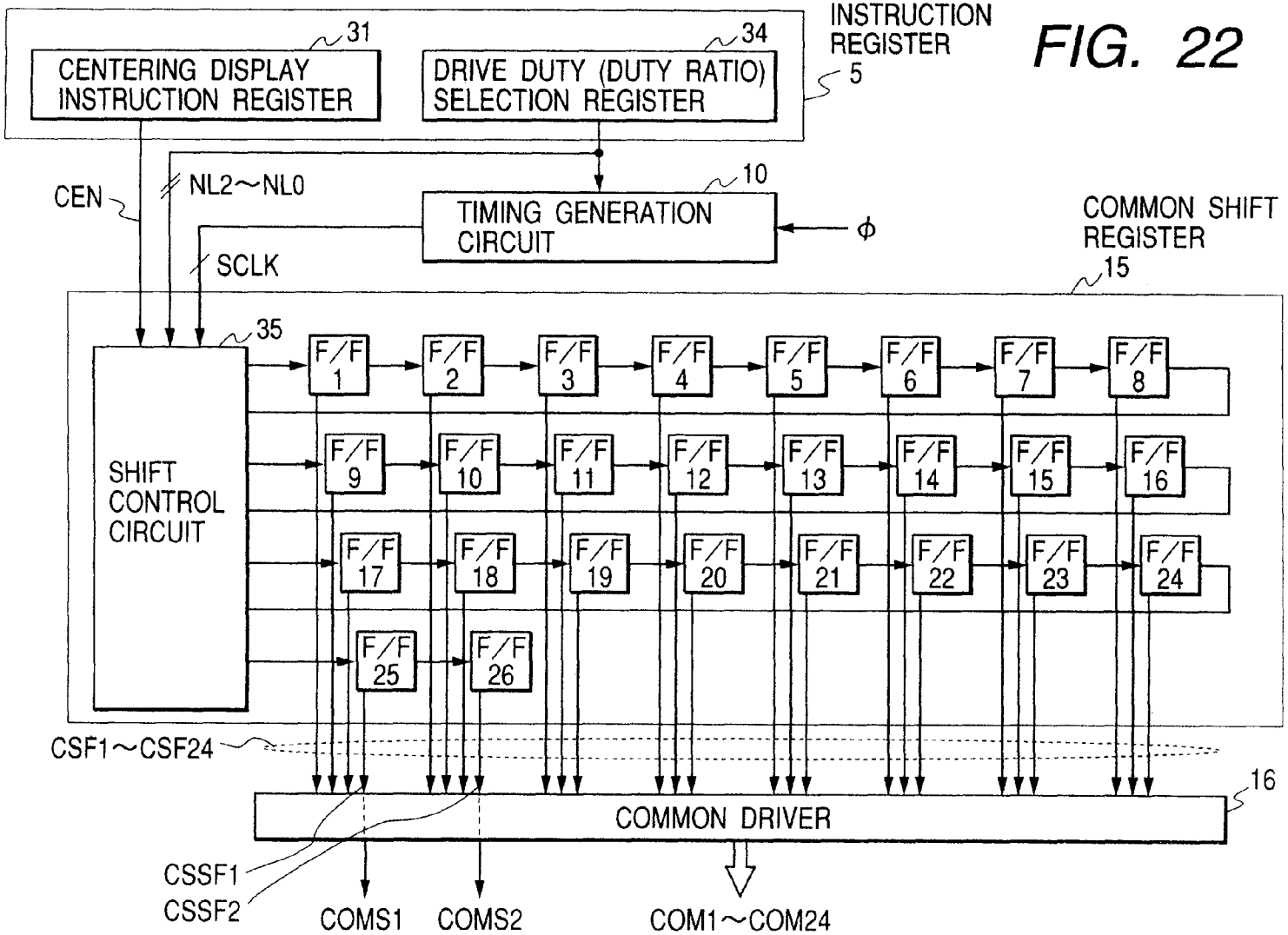
FIG. 22 is a circuit diagram illustrating, in detail, a common shift register of the embodiment of FIG. 21.

FIGS. 22 and 23 illustrate a modification in the common shift register 15 and a modification in the drive duty selection register 34 in the liquid crystal display controller 2 of FIG. 21.

The internal control bits of the drive duty selection register 34 are changed into three bits NL2 to NL0.

As shown in FIG. 23, when the bits NL2 to NL0 have a value 11000, segments (picture, mark, icon, etc.) only are displayed, and the common driver that is used is a drive for outputting segment common drive signals COMS1, COMS2. The drive duty in this case is 1/2. When the bits NL2 to NL0 have a value "001", there are displayed segments and characters of the dot-matrix type on the first row, and the common drivers that are used are drivers for outputting segment common drive signals COMS1, COMS2 and drivers for outputting common drive signals COM1 to COM8 for displaying a dot-matrix. The drive duty in this case is 1/10. When the bits NL2 to NL0 have a value 0020, there are displayed segments and characters of the dot-matrix type on the first and second rows, and the common drivers that are used are drivers for outputting segment common drive signals COMS1, COMS2 and drivers for outputting common drive signals COM1 to COM16 for displaying a dot-matrix. The drive duty in this case is 1/18. When the bits NL2 to NL0 have a value 0020, there are displayed segments and characters of the dot-matrix type on the first to third rows, and the common drivers that are used are drivers for outputting segment common drive signals COMS1, COMS2 and drivers for outputting common drive signals COM1 to COM24 for displaying a dot-matrix. The drive duty in this case is 1/26. Setting the bits NL2 to NL0 at values other than those described above is inhibited.

The common shift register 15 of FIG. 22 is modified as described below.

That is, the flip-flops 25 and 26 generate segment common drive signals COMS1 and COMS2. The following operation is carried out when the control bit CEN of the centering display instruction register 31 is "0". When the drive duty is 1/2, the shift register selection data "1" is shifted only to the flip-flop 25 and 26 to produce driver selection signals CSSF1 and CSSF2. When the drive duty is 1/10, the shift register selection data "1" is shifted to the flip-flops 1 to 9, 25 and 26 to produce driver selection signals CSF1 to CSF9, CSSF1 and CSSF2. When the drive duty is 1/18, the shift register selection data "1" is shifted to the flip-flops 1 to 16, 25 and 26 to produce driver selection signals CSF1 to CSF16, CSSF1 and CSSF2. When the drive duty is 1/26, the shift register selection data "1" is shifted to the flip-flops 1 to 24, 25 and 26 to produce driver selection signals CSF1 to CSDF24, CSSF1 and CSSF2.

When the control bit CEN of the centering display instruction register 31 is set at "1" by the microprocessor 3, the microprocessor 3 sets NL2 to NL0 at "001" and sets the drive bias selection registers BS2 to BS0 at "101". FIG. 24 illustrates a display on the liquid crystal panel 1 of when the 1/26 duty drive is changed to the 1/10 duty drive. The effect of the present invention is made tangible in the case of the portable telephone set 91 of FIG. 18 which shows the liquid crystal display system 150 of the invention.

Figure 25:
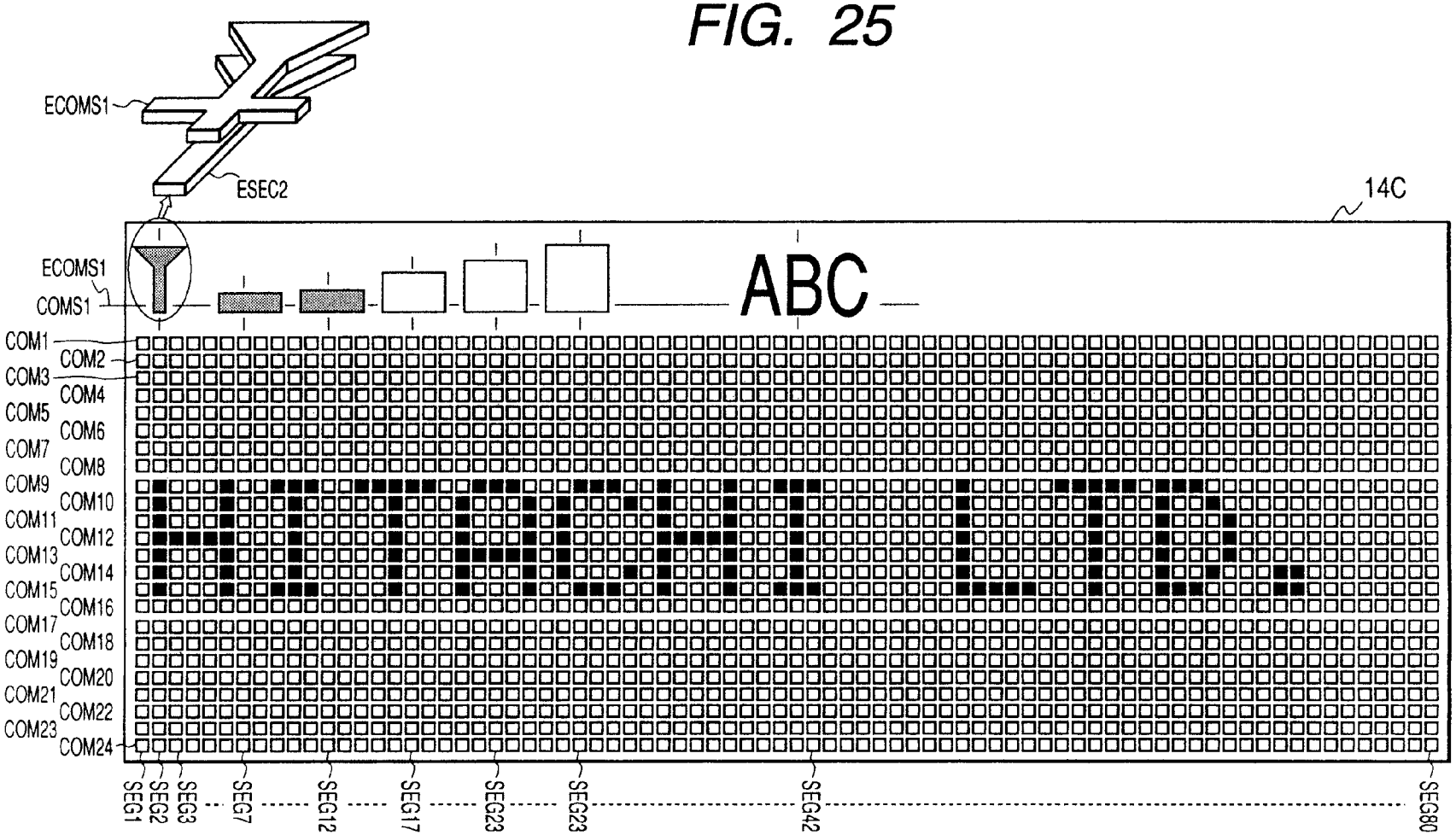
FIG. 25 is a diagram illustrating the constitution of a liquid crystal panel 140 of the embodiment of FIG. 21.

FIG. 25 shows an example of the liquid crystal panel 140. Transparent electrodes ECOMS1 supplied with a common signal COMS1 for displaying segment are arranged on the upper side of the panel. The segments (often called pictograms) such as marks, characters, figures, etc. are turned on by the selection level of the transparent electrodes ESEG and by the selection level of the transparent electrodes ECOMS1 supplied with segment signals SEG2, SEG7, SEG23, SEG28 and SEG 42 from the left. As shown, each segment has a pair of transparent electrodes of the same shape as the figure that is to be displayed, and one transparent electrode is connected to the transparent electrode ECOMS1 supplied with the common signal COMS1 for displaying a segment, and the other transparent electrode is connected to the transparent electrode ESEG2 supplied with the segment signal SEG2.

In the embodiment as described above, the liquid crystal display controller is provided with a drive duty selection register that can be rewritten by the microprocessor, and a drive bias selection register. When the display on the whole surface of the liquid crystal display panel is changed to the display of part of the rows, the preset values of the drive duty selection register and of the drive bias selection register are changed, so that the display is selectively produced on part of the liquid crystal display panel at a low voltage with a low-duty drive. Thus, only a portion of the liquid crystal display panel is selectively driven by the microprocessor at a low duty, making it possible to lower the operation frequency of the internal shift register and the voltage for driving the liquid crystal and, hence, to suppress the total electric current consumed by the whole liquid crystal display controller. Furthermore, the optimum drive bias is changed depending upon a change in the drive duty, making it possible to prevent the lowering of the contrast.

Moreover, provision is made of a boosting power selection register capable of setting the boosting power of the boosting circuit, and the boosting power of the boosting circuit is set to be low according to a decrease in the duty ratio. Accordingly, it is made possible to lower the boosted voltage to a required minimum limit and, hence, to lower the operation voltage of the liquid crystal drive power supply circuit, to improve the efficiency-of the boosting circuit and to suppress the electric current consumed by the semiconductor integrated circuit device 2.

Since the centering display instruction register is provided in the liquid crystal display controller, the display on part of the rows in the stand-by state is specified at a position where it can be most easily viewed, e.g., at a central portion on the liquid crystal display panel.

Though the invention accomplished by the present inventors has been concretely described above by way of embodiments, it should be noted that the present invention is in no way limited to the above-mentioned embodiments only but can be modified in various ways without departing from the spirit and scope of the invention. The above-mentioned embodiments have dealt with the liquid crystal display controller of the type that is successively driven line by line in a time-division manner. The invention, however, can also be applied to a liquid crystal display controller of the type which simultaneously and sequentially drives a plurality of lines. The above embodiments have dealt with the case where the display position of part of the rows is at the center of the screen in the stand-by state. It is, however, also possible to provide a register for setting the display position in the stand-by state, so that the display can be made at any position.

The above-mentioned embodiments have dealt with the case where the display portion of the liquid crystal display panel is constituted by a dot-matrix capable of displaying 4 character rows. By changing the number of the common drivers, however, the invention can be adapted to a liquid crystal display controller for driving a liquid crystal display panel capable of displaying 3 character rows or 5 or more character rows. In some portable telephone sets and the like, a pictogram where an antenna mark, a mark indicating the reception level, etc. is provided at the top portion or the bottom portion on the screen, and are generally constituted by electrodes of shapes corresponding to the marks. In this case, the common drivers in the liquid crystal display controllers should be so constituted as to output one more or two more common signals for the pictogram. Namely, only those common signals corresponding to the pictogram are selectively driven, but the character display portion is driven at the non-selection level at all times, to realize a low-duty drive such as 1/1 duty (static) drive, 1/2 duty, etc.

The foregoing description has-chiefly dealt with the case where the invention is adapted to the liquid crystal display controller which is in the field of utilizing the invention. The present invention, however, is in no way limited thereto only and can be utilized for controlling the drive of various display devices such of as phosphor indicator tube, or plasma display.

The effect obtained by a representative of the aspects of the invention disclosed in this application will be described below.

In the liquid crystal display controller for controlling a plurality of display rows, it is possible to decrease the consumption of electric current when the display needs not be produced on the whole rows such as in the stand-by state of the system. Since the control operation is entirely executed by the microprocessor with software, the liquid crystal is driven according to the operating state of the system consuming a minimum amount of electric power.

The invention claimed is:

1. A portable telephone comprising:

a liquid display panel having a plurality of first electrodes provided in a first direction and a plurality of second electrodes provided in a second direction which crosses in the first direction; and a liquid crystal display controller mounted on glass substrate that constitute the liquid display panel, coupled to the liquid display panel and for driving a liquid display panel, the liquid crystal display controller being enable to setting up a partial display area on the display panel by controlling a driving of ones of the plurality of second electrodes, the liquid crystal display controller comprising:

an interface circuit coupled to receive signals provided from an outside of the liquid crystal display controller;

a display RAM coupled to the interface circuit and storing display data to be displayed on the liquid display panel;

an address counter providing addresses of the display RAM;

a timing generation circuit;

a first driver coupled to the timing generation circuit and providing signals for driving the plurality of the first electrodes;

a second driver providing signals for driving the plurality of second electrodes in accordance with the display data read out from the display RAM; and a display position setting register coupled to the interface circuit and designating a position of the partial display area on the display panel, wherein the display position setting register is capable of being rewritten from the outside of the liquid crystal display controller via the interface circuit, wherein the first driver provides signals for driving ones of the plurality of first electrodes which are designated by the display position setting register, and the first driver provides a voltage of non-selection level to the other of the plurality of first electrodes which correspond to non-display area other than the partial display area in the liquid display panel.

2. A portable telephone according to claim 1, wherein the liquid crystal display controller further comprises:

a boosting circuit providing voltages to the first and the second driver; and a boost power setting register coupled to the interface circuit and setting a boost power of the boosting circuit.

3. A portable telephone according to claim 2, wherein the boost power setting register is capable of being rewritten from the outside of the liquid crystal display controller via the interface circuit.

4. A portable telephone according to claim 2, wherein the boosting circuit has a terminal to be coupled to a capacitance which is to be provided at the outside of the liquid crystal display controller.

5. A portable telephone according to claim 3, wherein the boosting circuit is capable of boosting up a voltage supplied from the outside of the liquid crystal display controller in twice or three times.

6. A portable telephone according to claim 1, wherein the first driver does not provide a voltage of non-selection level in an AC drive to the other of the plurality of first electrodes which correspond to non-display area other than the partial display area in the liquid display panel.

* * * * *

UNITED STATES PATENT AND TRADEMARK OFFICE

CERTIFICATE OF CORRECTION

PATENT NO. : 8,212,763 B2
APPLICATION NO. : 12/709929
DATED : July 3, 2012
INVENTOR(S) : Y. Yokota et al.

It is certified that error appears in the above-identified patent and that said Letters Patent is hereby corrected as shown below:

IN COLUMN 19

Please correct lines 40-52, as follows:

1. A portable telephone comprising:
a liquid display panel having a plurality of first electrodes provided in a first direction and a plurality of second electrodes provided in a second direction which crosses in the first direction; and
a liquid crystal display controller mounted on glass substrate that constitute the liquid display panel, coupled to the liquid display panel and for driving a liquid display panel, the liquid crystal display controller being ~~enable~~ enabled to ~~setting~~ set up a partial display area on the display panel by controlling a driving of ones of the plurality of ~~second~~ first electrodes, the liquid crystal display controller comprising:

Signed and Sealed this
Twelfth Day of March, 2013

Teresa Stanek Rea
*Acting Director of the United States Patent and Trademark Office*